US011571064B2

(12) United States Patent
Streets

(10) Patent No.: US 11,571,064 B2
(45) Date of Patent: Feb. 7, 2023

(54) SYSTEM INCLUDING A RAIL THAT IS INTERLOCKABLE WITH REPOSITIONABLE CLOSET BARS

(71) Applicant: Jeffrey Lowell Streets, Cypress, TX (US)

(72) Inventor: Jeffrey Lowell Streets, Cypress, TX (US)

(73) Assignee: Closet Toolz Corporation, Cypress, TX (US)

( * ) Notice: Subject to any disclaimer, the term of this patent is extended or adjusted under 35 U.S.C. 154(b) by 0 days.

(21) Appl. No.: 17/705,348

(22) Filed: Mar. 27, 2022

(65) Prior Publication Data

US 2022/0338626 A1 Oct. 27, 2022

Related U.S. Application Data

(63) Continuation-in-part of application No. 17/239,642, filed on Apr. 25, 2021, now Pat. No. 11,350,742.

(51) Int. Cl.
*A47B 61/02* (2006.01)
*A47B 61/00* (2006.01)

(52) U.S. Cl.
CPC ..... *A47B 61/02* (2013.01); *A47B 61/003* (2013.01)

(58) Field of Classification Search
CPC .. A47G 25/28; A47G 25/1457; A47G 25/145; A47G 25/02; A47G 25/276;
(Continued)

(56) References Cited

U.S. PATENT DOCUMENTS 1,375,611 A * 4/1921 Schoell ..... B60R 7/10 211/7
1,415,316 A * 5/1922 Corbin ..... A47B 61/02 211/85.3

(Continued)

FOREIGN PATENT DOCUMENTS

EP 1205137 A1 5/2002

OTHER PUBLICATIONS

USPTO, "Office Action for U.S. Appl. No. 17/239,672, filed Apr. 25, 2021 (including Notice of Cited references, and IDS Statement by Applicant)", dated Nov. 30, 2021; 46 pages.

(Continued)

*Primary Examiner* — Devin K Barnett

(57) ABSTRACT

A system includes a rail having a rail body that includes a perimeter edge and first and second channels. The first and second channels each include a seat, brace and passageway extending from the perimeter edge of the rail body to the seat. Each seat has an arc greater than 90 degrees. An upwardly directed surface of a first brace may be substantially colinear with the second upwardly directed surface of a second brace, and the first and second channels are separated by a working area that may be used to secure hook, pegs and the like. The first and second elongate rigid bars are configured to be positioned between a closet shelf and rod. Each rigid bar includes a distal section with an upward facing surface for engaging the closet shelf, a downward facing surface for engaging the closet rod, and an intermediate section having a semicircular cross-section.

20 Claims, 10 Drawing Sheets

(58) Field of Classification Search
CPC .... A47G 25/74; A47G 25/4053; A47G 25/44; A47G 25/0692; A47G 25/743; A47G 25/14; A47F 5/00; A47F 5/0006; A47F 5/0807; A47F 5/0838; A47F 7/00; A47F 7/12; A47F 7/19; A47B 61/02; A47B 61/003; A47B 96/067; A47B 96/14; A47B 96/1408; B60R 7/10
USPC ..... 211/85.3, 105.1–105.4, 123, 124; 223/85
See application file for complete search history.

(56) References Cited

U.S. PATENT DOCUMENTS 1,587,675 A 6/1926 Patterson
1,639,021 A * 8/1927 Batts ..... A47B 61/003 211/175
1,674,758 A * 6/1928 Batts ..... A47B 61/02 211/85.3
1,695,517 A * 12/1928 Waldbauer ..... E05B 69/006 211/124
1,854,393 A * 4/1932 Berg ..... A47B 61/02 248/294.1
2,045,942 A * 6/1936 Brody ..... F16B 12/40 211/182
2,661,850 A * 12/1953 Fowler ..... A47H 1/022 211/105.4
2,859,879 A 11/1958 Rogers et al.
2,908,471 A * 10/1959 Hollansworth ..... A47B 96/027 108/29
2,917,185 A * 12/1959 Kovacs ..... A47G 25/746 211/94.01
2,985,311 A * 5/1961 Abel ..... A47G 25/746 211/85.3
3,032,273 A * 5/1962 Spielman ..... A47G 25/0685 239/57
3,116,837 A * 1/1964 Kelly ..... A47B 61/02 211/94.01
3,124,253 A 3/1964 Petrich
3,148,808 A * 9/1964 Griffin ..... A47G 25/60 223/86
3,282,548 A * 11/1966 Ruhnke ..... A47B 61/003 256/65.16
3,286,850 A * 11/1966 Ruhnke ..... A47B 61/003 256/65.16
3,335,872 A * 8/1967 Dodich ..... A47G 25/746 211/85.3
3,389,807 A * 6/1968 Manning ..... H03H 7/01 211/85.3
3,424,314 A * 1/1969 Cornelsen ..... B60R 7/10 248/323
3,471,031 A 10/1969 Coplan
3,518,421 A * 6/1970 Cogdill ..... F21V 21/02 248/248
3,784,023 A * 1/1974 Varon ..... A47H 1/14 211/105.1
D236,053 S 7/1975 Friedberg
3,897,122 A * 7/1975 McEvers ..... A47G 25/746 211/85.3
3,954,182 A * 5/1976 McEvers ..... A47G 25/746 211/94.01
D243,978 S 4/1977 Lallement
D245,134 S 7/1977 Friedberg
4,087,006 A 5/1978 Schill
4,103,781 A 8/1978 Sterling
4,104,972 A * 8/1978 Baublitz ..... A47B 61/02 211/85.3
4,105,127 A * 8/1978 Holl ..... G09F 7/18 211/124
4,108,315 A * 8/1978 Inao ..... D06F 57/00 211/124
4,111,309 A * 9/1978 Henry ..... A47B 61/02 211/180
4,139,102 A * 2/1979 Winton ..... E05B 69/006 211/124
4,316,547 A * 2/1982 Varon ..... A47G 25/0692 211/124
4,407,476 A * 10/1983 Bohannan ..... A47B 96/021 211/90.01
4,427,119 A * 1/1984 Savino ..... A47G 25/746 211/94.01
D273,645 S * 5/1984 McEvers ..... D6/513
4,474,299 A * 10/1984 Andrews ..... A47F 7/24 211/193
4,488,651 A * 12/1984 Bishop ..... A47K 3/38 211/105.6
D277,248 S * 1/1985 Benedict ..... D6/324
D277,436 S * 2/1985 Benedict ..... D6/315
D280,575 S * 9/1985 Benedict ..... D6/315
D280,785 S * 10/1985 Benedict ..... D6/315
4,585,127 A * 4/1986 Benedict ..... A47B 61/02 211/94.01
4,593,839 A * 6/1986 Vandoros ..... D06F 59/02 223/63
4,643,318 A * 2/1987 Kopp ..... A47K 17/022 403/2
4,720,016 A * 1/1988 Kay ..... A47B 61/003 211/175
4,760,929 A * 8/1988 Fedorchak ..... A47F 7/24 211/105.1
4,771,899 A * 9/1988 Benedict ..... A47B 61/02 211/94.01
4,863,043 A 9/1989 Bowen
5,107,996 A 4/1992 Whittaker
5,139,298 A * 8/1992 Dowell ..... A47G 25/145 294/165
5,178,287 A 1/1993 Klein et al.
5,337,905 A * 8/1994 Gast ..... A47B 61/02 211/85.3
5,351,842 A * 10/1994 Remmers ..... A47B 96/028 108/29
5,499,725 A * 3/1996 Palumbo ..... A47K 3/001 211/119.009
5,531,416 A * 7/1996 Remmers ..... A47G 25/0692 248/222.51
5,582,303 A * 12/1996 Sloan ..... A47G 25/0692 211/105.1
5,697,508 A * 12/1997 Rifkin ..... B65G 9/002 211/124
5,702,010 A * 12/1997 Liang ..... D06F 57/122 211/206
5,803,273 A * 9/1998 Menaged ..... A47F 5/0823 211/105.3
6,053,465 A * 4/2000 Kluge ..... A47B 61/003 248/248
6,394,289 B1 5/2002 Panchihak et al.
6,409,131 B1 * 6/2002 Bentley ..... A61M 5/1415 248/230.1
6,655,538 B2 * 12/2003 Saulnier-Matteini ..... A47B 45/00 211/175
6,976,595 B1 * 12/2005 Geller ..... A47F 5/0838 211/124
7,490,424 B2 * 2/2009 Caterinacci ..... G09F 7/20 40/606.14
8,002,127 B2 * 8/2011 Ward ..... A47B 61/02 211/124
8,051,781 B1 * 11/2011 Vind ..... A47K 3/38 211/105.6
8,397,961 B2 3/2013 Viehe
8,783,474 B2 * 7/2014 Kuhlman ..... A47K 10/04 211/2
9,022,237 B2 * 5/2015 Hall ..... A47B 81/04 211/162
9,089,245 B1 * 7/2015 Pamphilis ..... A47K 10/04
9,290,133 B1 * 3/2016 Bishop ..... A47G 25/0692
9,387,810 B1 * 7/2016 Bishop ..... A47G 25/08
9,402,494 B1 * 8/2016 O'Brien ..... A47F 7/19
D806,408 S 1/2018 Womble

(56) References Cited

U.S. PATENT DOCUMENTS 10,021,975 B1 * 7/2018 Womble ..... A47B 96/021
10,449,908 B1 * 10/2019 Bishop ..... B60R 7/10
D893,894 S * 8/2020 Womble ..... D6/327
11,072,292 B1 * 7/2021 Martin, IV ..... B60R 7/10
2002/0148797 A1 * 10/2002 Feder ..... A47F 7/24 211/124
2002/0153337 A1 * 10/2002 Shuen ..... B60R 7/10 211/105.3
2002/0166204 A1 * 11/2002 Chen ..... A47B 61/003 16/87 R
2003/0071001 A1 * 4/2003 Goldberg ..... A47G 25/0692 211/105.3
2003/0111435 A1 * 6/2003 Chen ..... F21V 33/0012 211/105.1
2004/0182808 A1 * 9/2004 Norris, Sr. ..... A47G 25/32 211/105.1
2004/0262249 A1 * 12/2004 Tomonari ..... A47B 57/34 211/90.02
2005/0029208 A1 2/2005 Paiste et al.
2005/0230577 A1 * 10/2005 Chen ..... A47B 61/003 248/304
2005/0247837 A1 11/2005 Spencer
2006/0070966 A1 * 4/2006 Koudys ..... A47B 61/02 211/105.3
2006/0231516 A1 * 10/2006 Moore ..... A47G 25/0692 211/85.3
2006/0278594 A1 * 12/2006 Macon ..... A47B 61/003 211/123
2008/0135508 A1 * 6/2008 Fogolin ..... E04F 10/067 211/105.1
2008/0156837 A1 * 7/2008 Brightman ..... B60R 7/10 224/313
2009/0278010 A1 * 11/2009 Cotter ..... A47B 61/003 248/251
2010/0050425 A1 * 3/2010 Ji ..... H05K 7/1417 29/739
2010/0282788 A1 * 11/2010 Liberti ..... A47G 25/445 223/96
2012/0080394 A1 * 4/2012 Shorty ..... A47G 25/0685 211/123
2012/0305610 A1 12/2012 Womble
2013/0113230 A1 * 5/2013 Gobart ..... B60R 7/10 296/1.08
2014/0126152 A1 * 5/2014 Yang ..... H01L 23/4006 361/704
2014/0291461 A1 10/2014 Womble
2015/0053632 A1 * 2/2015 Brinton, Jr. ..... A47B 61/003 248/225.11
2015/0335153 A1 * 11/2015 Singleton ..... A47B 61/02 211/85.15
2017/0090527 A1 * 3/2017 Chi ..... H05K 7/12
2017/0332782 A1 * 11/2017 Castro ..... A47G 25/0692
2018/0055264 A1 * 3/2018 Mustafa ..... A47G 25/0685
2018/0177292 A1 * 6/2018 Rindler ..... A47B 61/003
2019/0021491 A1 * 1/2019 Womble ..... F16B 45/00
2019/0191910 A1 * 6/2019 Davis ..... A47B 61/003
2020/0205564 A9 7/2020 Womble
2022/0241662 A1 * 8/2022 Burk ..... A63B 71/022

OTHER PUBLICATIONS

Jeffrey L. Streets, "Response to Office Action dated Nov. 30, 2021 for U.S. Appl. No. 17/239,672, filed Apr. 25, 2021", dated Jan. 6, 2022; 48 pages.
USPTO, "Notice of Allowance and Fee(S) Due (including Notice of Allowability) for U.S. Appl. No. 17/239,672, filed Apr. 25, 2021", dated Mar. 1, 2022; 19 pages.

* cited by examiner

SYSTEM INCLUDING A RAIL THAT IS INTERLOCKABLE WITH REPOSITIONABLE CLOSET BARS

CROSS-REFERENCE TO RELATED APPLICATIONS

This application is a continuation-in-part of U.S. patent application Ser. No. 17/239,642 filed on Apr. 25, 2021, which application is incorporated by reference herein.

BACKGROUND

The present disclosure relates to devices that provide closet storage and organization.

BACKGROUND OF THE RELATED ART

A closet is a space that is enclosed in some manner for the purpose of storing various items within a residential home, apartment or other building. Closets may be used to store a wide variety of useful and personal items that people generally desire to keep out of constant view, either to maintain an organized and uncluttered appearance or to maintain some privacy regarding the stored items. Therefore, an amount of available closet space is an important factor that people consider when selecting a home or apartment in which to live.

While closets may be added to a home and an existing closet may be expanded to include more space, these are expensive options that may also be detrimental to the functionality or appearance of other spaces within the home. Accordingly, there is much attention given to efficient organization and storage within the available space of an existing closet. Stationary shelving and closet rod systems are a standard feature that are built into most residential closets. Furthermore, custom closet solutions may be designed and installed specifically to address the storage needs of a particular person in a particular closet. In addition to fixed shelving and closet rods, custom closet solutions may include, for example, drawers, cabinets, shoe organizers, and other features that improve the utilization of the existing closet space. Unfortunately, custom closet solutions are also expensive and not a practical option for a person in an apartment where permanent modifications are generally not permitted.

The competing demands placed on a closet and the practical limitations on how a closet can be customized at a reasonable cost have led to the development of numerous independent devices for organizing and storing items in a closet. These devices are independent in the sense that they can be easily utilized or implemented without requiring further components or changes to the existing structure of the closet. Examples of these devices may include specialty hangers, storage bins, shoe racks, door-mounted storage, wall hooks, and stackable shelves. However, since the individual preferences of each person are unique, there is a continuing need for devices that will help each person use their own existing closet space in an efficient and appealing manner that satisfies their specific needs and preferences.

BRIEF SUMMARY

Some embodiments provide a system comprising: a rail having an elongate rail body, wherein the elongate rail body includes a perimeter edge, a first channel and a second channel; the first channel including a first seat, a first brace, and a first passageway extending into the elongate rail body from the perimeter edge of the rail body to the first seat, wherein the first seat has a first arc greater than 90 degrees, wherein the first passageway has a first side that is substantially tangent to the first arc and a second side that is substantially aligned with a first central axis of the first arc, and wherein the first brace has a first upwardly directed surface that extends substantially laterally along a first radial line of the first arc of the first seat; the second channel including a second seat, a second brace, and a second passageway extending into the elongate rail body from the perimeter edge of the rail body to the second seat, wherein the second seat has a second arc greater than 90 degrees, wherein the second passageway has first side that is substantially tangent to the second arc and a second side that is substantially aligned with a second central axis of the second arc, and wherein the second brace has a second upwardly directed surface that extends substantially laterally along a second radial line of the second arc of the second seat; wherein the first upwardly directed surface of the first brace is substantially colinear with the second upwardly directed surface of the second brace, and wherein the first and second channels are separated by a working area of the elongate rail body; and first and second elongate rigid bars configured to be positioned between a closet shelf and a closet rod, each elongate rigid bar including a distal section with an upward-facing surface for engaging a bottom surface of the closet shelf, a downward-facing surface for engaging a top surface of the closet rod, and an intermediate section having a semicircular cross-section, wherein the semicircular cross-section has a flat base and an upwardly facing surface having a semicircular arc.

Some embodiments provide a system comprising: a rail having an elongate rail body, wherein the elongate rail body includes a perimeter edge, a first channel and a second channel; the first channel including a first seat, a first brace, and a first passageway extending into the elongate rail body from the perimeter edge of the rail body to the first seat, wherein the first seat has a first arc greater than 90 degrees, wherein the first passageway has a first side that is substantially tangent to the first arc and a second side that is offset by 1-4 millimeters from alignment with a first central axis of the first arc, and wherein the first brace has a first upwardly directed surface that extends laterally along a line that is offset by 1-4 millimeters from a first radial line of the first arc of the first seat; the second channel including a second seat, a second brace, and a second passageway extending into the elongate rail body from the perimeter edge of the rail body to the second seat, wherein the second seat has a second arc greater than 90 degrees, wherein the second passageway has first side that is substantially tangent to the second arc and a second side that is offset by 1-4 millimeter from alignment with a second central axis of the second arc, and wherein the second brace has a second upwardly directed surface that extends laterally along a line that is offset by 1-4 millimeters from a second radial line of the second arc of the second seat; wherein the first upwardly directed surface of the first brace is substantially colinear with the second upwardly directed surface of the second brace, and wherein the first and second channels are separated by a working area of the elongate rail body; and first and second elongate rigid bars configured to be positioned between a closet shelf and a closet rod, each elongate rigid bar including a distal section with an upward-facing surface for engaging a bottom surface of the closet shelf, a downward-facing surface for engaging a top surface of the closet rod, and an intermediate section having a semicircular cross-section, wherein the semicircular cross-section has a flat base and an upwardly facing surface having a semicircular arc.

Some embodiments provide a repositionable closet bar for hanging clothes. The repositionable closet bar comprises an elongate rigid bar having a distal section, a proximal section and an intermediate section between the distal section and the proximal section, wherein the distal section has an upward-facing surface for engaging a bottom surface of a closet shelf, wherein the intermediate section has an upward-facing surface that is convex across a width of the intermediate section for receiving and supporting a hook of a clothes hanger, wherein the proximal section has an upward-facing surface that extends radially outward beyond at least a portion of the convex surface of the intermediate section, and wherein the elongate rigid bar further includes a downward-facing surface for engaging a top surface of a closet rod.

Some embodiments provide a repositionable closet bar for hanging clothes consisting essentially of an elongate rigid bar, a hook, and first and second compressible gripping pads. The elongate rigid bar has a distal section, a proximal section and an intermediate section between the distal section and the proximal section, wherein the distal section has an upward-facing surface, wherein the intermediate section has an upward-facing surface that is convex across a width of the intermediate section for receiving an supporting a hook of a clothes hanger, wherein the proximal section has an upward-facing surface that extends radially outward beyond at least a portion of the convex surface of the intermediate section, and wherein the elongate rigid bar further includes a downward-facing surface. The hook extends from a proximal end of the elongate rigid bar in a longitudinal direction of the elongate rigid bar. The first compressible gripping pad is secured to the upward-facing surface of the distal section for engaging a bottom surface of a closet shelf and the second compressible gripping pad is secured to the downward-facing surface of the elongate rigid bar for engaging a top surface of a closet rod.

Some embodiments provide a repositionable closet bar for hanging clothes consisting essentially of an elongate rigid bar having a monolithic structure that comprises a distal section, a proximal section and an intermediate section between the distal section and the proximal section, wherein the elongate rigid bar is configured to be positioned between a closet shelf and a closet rod. The distal section has a flat upward-facing surface for engaging a bottom surface of the closet shelf, the intermediate section has an upward-facing surface that is convex across a width of the intermediate section for receiving and supporting a hook of a clothes hanger, the intermediate section has a cross-sectional profile that is semicircular, the proximal section has an upward-facing surface that extends radially outward beyond at least a portion of the upward-facing surface of the intermediate section, and the elongate rigid bar further includes a downward-facing surface that is flat for engaging a top portion of the closet rod. At least one compressible gripping pad is adhesively secured to the elongate rigid bar, wherein the at least one compressible gripping pad is configured to directly engage at least one of the bottom surface of the closet shelf and the top portion of the closet rod. The elongate rigid bar is configured to be repositioned side-to-side between the closet shelf and the closet rod and is configured to be repositioned in a forward direction or a rearward direction between the closet shelf and the closet rod. When in use, no portion of the elongate rigid bar is fastened to the closet shelf and no portion of the elongate rigid bar is fastened to the closet rod.

Some embodiments provide a repositionable closet bar for hanging clothes consisting essentially of: an elongate rigid bar having a monolithic structure that comprises a distal section, a proximal section and an intermediate section between the distal section and the proximal section, wherein the distal section has a flat upward-facing surface and the distal section is configured to be inserted between a lower front edge of a closet shelf and a top portion of a closet rod, wherein the intermediate section has an upward-facing surface that is convex across a width of the intermediate section, wherein the intermediate section has a cross-sectional profile that is semicircular, wherein the proximal section has an upward-facing surface that extends radially outward beyond at least a portion of the upward-facing surface of the intermediate section, wherein the elongate rigid bar further includes a downward-facing surface that is flat, wherein the elongate rigid bar is configured to be repositioned side-to-side between the closet shelf and the closet rod and the elongate rigid bar is configured to be repositioned in a forward direction or a rearward direction between the closet shelf and the closet rod, and wherein, when in use, no portion of the elongate rigid bar is fastened to the closet shelf and no portion of the elongate rigid bar is fastened to the closet rod; a hook that extends from a proximal end of the proximal section of the elongate rigid bar, wherein the hook extends in a longitudinal direction of the elongate rigid bar; a first compressible gripping pad adhesively secured to the upward-facing surface of the distal section, wherein the first compressible gripping pad is configured to directly engage a bottom surface of the closet shelf; and a second compressible gripping pad adhesively secured to the downward-facing surface of the elongate rigid bar, wherein the second compressible gripping pad is configured to directly engage the top portion of the closet rod.

DETAILED DESCRIPTION

Figure 1A:
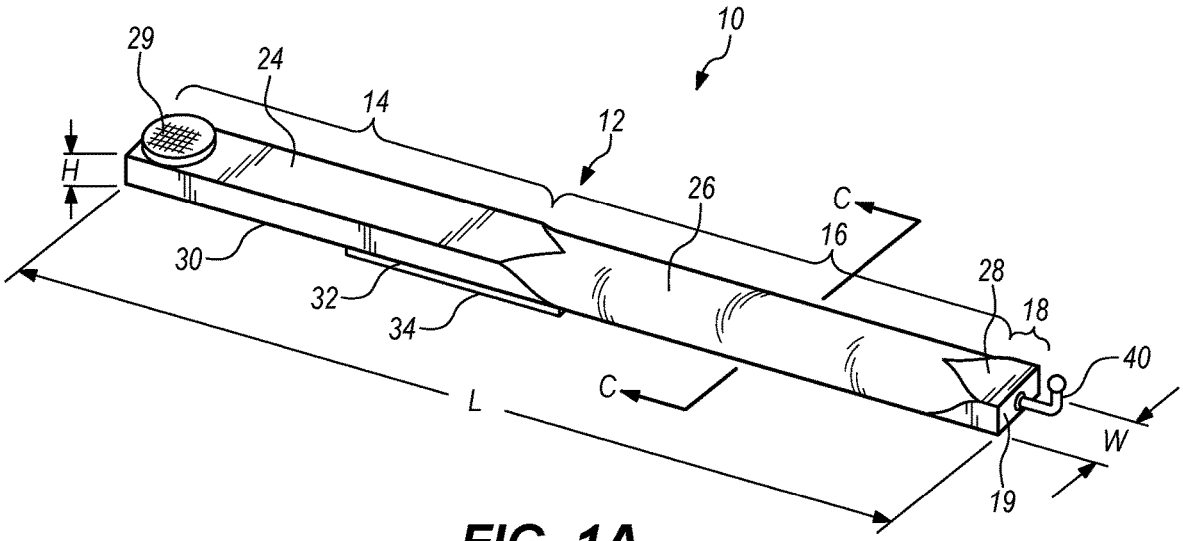
FIG. 1A is a top perspective view of a repositionable closet bar according to some embodiments.

Some embodiments provide a repositionable closet bar for hanging clothes. The repositionable closet bar comprises an elongate rigid bar having a distal section, a proximal section and an intermediate section between the distal section and the proximal section, wherein the distal section has an upward-facing surface for engaging a bottom surface of a closet shelf, wherein the intermediate section has an upward-facing surface that is convex across a width of the intermediate section for receiving and supporting a hook of a clothes hanger, wherein the proximal section has an upward-facing surface that extends radially outward beyond at least a portion of the convex surface of the intermediate section, and wherein the elongate rigid bar further includes a downward-facing surface for engaging a top surface of a closet rod.

Embodiments of the repositionable closet bar may be used in conjunction with a standard closet shelf and closet rod combination or similar installed closet system. A first example of such a standard closet shelf and closet rod combination use a metal bracket to support a closet shelf and to support a closet rod just below the front edge of the shelf. The closet shelf and closet rod are both typically made of wood and are fastened to the metal bracket with screws. A narrow gap between the shelf and the closet rod allows a hook of a clothes hanger to be place over the closet rod. Clothes on clothes hangers may be hung along the entire length of the closet rod. A second example of a standard closet system has an open wire closet shelf and an integral open wire strip for receiving the hooks of numerous clothes hangers. Some embodiments of the repositionable closet bar may be used in conjunction with one or more of these or other closet shelf and closet rod combinations.

Embodiments of the repositionable closet bar may be placed into an operative position for use by grasping the intermediate or proximal sections of the elongate rigid bar so that the elongate rigid bar is oriented for use (i.e., with the top surface of the elongate rigid bar facing upward). Then, the distal section of the elongate rigid bar may be inserted between the lower front edge of the closet shelf and the top surface or edge of the closet rod so that the elongate rigid bar is generally perpendicular to the front edge of the closet shelf and the closet rod. The distal section may be further positioned so that the upward-facing surface of the distal section engages the bottom surface of the closet shelf, such as a mid-point or back portion of the bottom surface of the closet shelf. The elongate rigid bar may then be lowered until the upward-facing surface of the distal section engages the bottom surface of the closet shelf and until the downward-facing surface of the elongate rigid bar rests on the top surface of the closet rod. In this operative position, the proximal section and at least a portion of the intermediate section may extend proximally outward from the closet shelf and the closet rod (i.e., away from the closet wall and toward an accessible area of the closet). Clothes hangers, with or without clothes presently hung on the clothes hangers, may be hung from any portion of the intermediate section that is accessible. In some situations, the intermediate section may be accessible and useable for receiving clothes hangers from the interface with the proximal end of the intermediate section and rearward along the elongate rigid bar to the point where the elongate rigid bar rests on the top surface of the closet rod. However, this situation can only be implemented if there are no clothes hangers hanging from the closet rod for several inches in both directions from where the repositionable closet bar has been located. In a more likely situation, the intermediate section may be accessible and useable for receiving clothes hangers from the proximal end of the intermediate section and rearward along the elongate rigid bar only to the point where there is interference from clothes hangers that are hanging from the closet rod.

Embodiments of the repositionable closet bar may be used in any desirable manner after being placed in an operative position. In a first example, the repositionable closet bar may be used to add storage capacity to a closet. Since the repositionable closet bar may engage the closet rod in an unused space between two adjacent hangers (for example, a gap as little as 1 to 1.5 inches wide), the repositionable closet bar does not significantly interfere with the use of hangers to hang clothes on the pre-existing closet rod and, therefore, there is no loss of storage capacity of the closet rod. Furthermore, since the repositionable closet bar extends beyond the clothes hanger space of the pre-existing closet rod, the hanger space on the repositionable closet bar provides additional hanger space that was not previously present in the closet. So, the repositionable closet bar may be beneficial to an individual with a closet that does not have enough hanging space (i.e., linear length of the closet rod) for all of their hanging clothes (i.e., clothes hung on clothes hangers). In a second example, the repositionable closet bar may be used to display or stage selected clothes in a forward-facing orientation so that the front or back of the clothes on a hanger can be viewed rather than simply seeing a narrow side edge of the clothes. The front of the clothes that are hung on the repositionable closet bar with a hanger is easy for the individual to view since the hanger hangs generally perpendicular to the repositionable closet bar, which means that the hanger hangs generally parallel to the pre-existing closet rod. In the process of selecting two or more clothing pieces to be worn together as an outfit, an individual may prefer to see the front of the clothes and/or see multiple pieces of the outfit together to judge how well they go together or evaluate the overall look of the outfit in view of a particular event where the outfit is to be worn. Furthermore, once a certain outfit has been selected, it may be desirable to hang the clothing pieces of that outfit on the repositionable closet bar so that the outfit is separated from the rest of the individual's wardrobe. Accordingly, the outfit is handy when needed and the clothing pieces are better able to hang free to remove any wrinkles. In embodiments of the repositionable closet bar that include a hook on the proximal end, the individual may further display or stage one or more accessories to the outfit, such as a belt, tie, necklace, scarf and the like. It should also be appreciated that the repositionable closet bar may be used to hang various other personal items, such as a small duffle bag with straps, a bathing suit or towel to be hung while drying, an outfit to be steamed, or a jacket that is too wet or dirty to hang where it contacts other clothes. Even further, if a portion of the closet space located below a closet rod is being used for storage, the repositionable closet bar may still be used to hang some clothes in front of the stored items to increase the storage capacity or to simply hide some of the stored items from view. Still, due to the ease with which the repositionable closet bar can be repositioned within a closet, an individual may use the repositionable closet bar for one purpose in one location of their closet and then quickly use the repositionable closet bar for the same or different purpose in a second location of their closet or another closet. It is also desirable to have multiple units of the repositionable closet bar within a closet to create even more storage capacity and/or to display or stage additional outfits or personal items. Some individuals will enjoy using a first repositionable closet bar to hang a first forward-facing outfit and a second repositionable closet bar to hang a second forward-facing outfit near to the first forward-facing outfit in order to facilitate a comparison and selection of the desired outfit.

Embodiments of the repositionable closet bar may also be used to add storage space that is qualitatively different than any of the storage space that is otherwise available in the closet. For example, a closet having a first lower closet shelf and closet rod combination and a second upper closet shelf and closet rod combination may not provide any long hanging space as is desirable for hanging a long dress. By placing the repositionable closet bar in an operative position in conjunction with the upper closet shelf and closet rod combination, the resulting hanger space created by the repositionable closet bar enables a long dress to be hung in front of both the first and second closet shelf and closet rod combinations without the long dress touching the floor.

It should also be appreciated that a benefit of some embodiments is that the use of the repositionable closet bar in a closet does not require any modification or damage to the existing closet walls, closet shelves or closet rods. This may be of particular benefit to an individual that moves from one apartment to another apartment, since there is no damage to be repaired before moving. Furthermore, the repositionable closet bar can be taken with the individual when they move.

In some embodiments of the repositionable closet bar, the upward-facing surface of the distal section may be flat or otherwise configured for engaging a bottom surface of a shelf, the downward-facing surface of the elongate rigid bar may be flat or otherwise configured for engaging a top surface of a closet rod, and/or the upward-facing surface of the proximal section extends radially outward beyond at least a portion of the convex surface of the intermediate section for preventing the hook of the clothes hanger from sliding over the proximal section.

In some embodiments of the repositionable closet bar, the elongate rigid bar has a sufficient length for at least a portion of the upward-facing surface of the distal section to extend distally to engage the bottom surface of the closet shelf with the downward-facing surface engaging the top surface of the closet rod and for at least a portion of the intermediate section to extend proximally beyond a space for hanging clothes from the closet rod.

In some embodiments of the repositionable closet bar, the elongate rigid bar has a monolithic structure having no fasteners for connecting to the closet shelf, the closet rod, or any other structure. In fact, the elongate rigid bar may be considered to be "floating" in the sense that an individual can freely move the elongate rigid bar side-to-side and/or front-to-back at any moment. The repositionable closet bar can be immediately positioned for use anywhere that there is a closet shelf and closet rod combination without any configuration or installation required. In addition, embodiments having the monolithic structure do not require the use of any tools and have no moving internal parts to wear out or become damaged. In some embodiments, the elongate rigid bar is repositionable side-to-side between a closet shelf and a closet rod (i.e., along the length of the closet rod) and repositionable front-to-back between the closet shelf and the closet rod (i.e., changing the distance from the closet wall) without requiring any reconfiguration of the elongate rigid bar.

In some embodiments, the repositionable closet bar may include one or more first compressible gripping pad secured to the upward-facing surface of the distal section, which may be flat or otherwise configured to receive the first compressible gripping pad. Accordingly, when the repositionable closet bar is placed into an operative position, the first compressible gripping is positioned to engage the bottom surface of the shelf instead of the upward-facing surface. During use of the repositionable closet bar, at least a portion the first compressible gripping pad may be in slight compression between the upward-facing surface of the distal end and the bottom of the closet shelf. The compressibility of the pad enables the pad to contact the bottom surface of the closet shelf over a greater amount of surface area than the solid surface of the distal end, especially considering that the angle between the repositionable closet bar and the bottom of the closet shelf may vary with changes in the front-to-back position of the repositionable closet bar. The first compressible gripping pad or pads may, without limitation, be round or rectangular. Furthermore, the first compressible gripping pad may or may not extend entirely to the distal end or one or both side edges of the upward facing surface but is preferably about as broad as the elongate rigid bar to provide stability and additional grip.

In some embodiments, the repositionable closet bar may include one or more second compressible gripping pad secured to the downward-facing surface of the elongate rigid bar, which may be flat or otherwise configured to receive the second compressible gripping pad. Accordingly, when the repositionable closet bar is placed into an operative position, the second compressible gripping pad engages the top of the closet rod instead of the downward-facing surface. During use of the repositionable closet bar, at least a portion of the second compressible gripping pad may be in slight compression between the downward-facing surface and the top surface of the closet rod, which may increase the amount of surface area of the second compressible gripping pad that contacts the closet rod. The second compressible gripping pad may or may not extend to one or both side edges of the downward facing surface but is preferably about as broad as the elongate rigid bar to provide stability and further increase the amount of surface area that contributes to gripping the closet rod. However, the second compressible gripping pad is preferably about 6 to about 10 inches in length so that at least a portion of the second compressible gripping pad will engage the top surface of the closet rod over a broad range of front-to-back positions of the repositionable closet bar. For example, with the repositionable closet bar positioned so that the upward-facing surface of the distal section of the elongate rigid bar, or the first compressible gripping pad secured to the upward-facing surface, engages the bottom surface of the closet shelf as near the wall as possible, then a proximal portion of the second compressible gripping pad will preferably engage the top surface of the closet rod. Furthermore, with the repositionable closet bar positioned so that the upward-facing surface of the distal section of the elongate rigid bar, or the first compressible gripping pad secured to the upward-facing surface, engages the bottom surface of the closet shelf at a mid-point of the closet shelf from front to back, then a distal portion of the second compressible gripping pad will preferably engage the top surface of the closet rod. Optionally, the position and length of the second compressible gripping pad may be used to inform or guide an individual as to the limits of a recommended range of front-to-back positions for the elongate rigid bar. While the back wall of the closet behind the closet shelf is one physical limit for the distal section, the elongate rigid bar is preferably not positioned so far forward that the upward-facing surface of the distal section, or the first compressible gripping pad secured to the upward-facing surface, no longer firmly or squarely engages the bottom surface of the closet shelf. For a closet shelf and closet rod combination having a 1-inch to 1.5-inch vertical gap between the bottom of the closet shelf and the top of the closet rod, it is preferable for the upward-facing surface of the distal section, or the first compressible gripping pad secured to the upward-facing surface, to engage the bottom of the shelf about 6 inches or more back from the front edge of the closet shelf.

In some embodiments, the repositionable closet bar may include a hook extending from a proximal end of the elongate rigid bar. The hook may be any useful shape or type, such as a straight hook, curved hook, or an L-shaped hook. The hook preferably extends in a longitudinal direction relative of the elongate rigid bar. The elongate rigid bar has a length (longitudinal dimension) that is several multiples greater than either the height (vertical dimension) or the width (lateral dimension), and the hook may extend in the longitudinal direction from the proximal end of the elongate rigid bar.

In some embodiments of the repositionable closet bar, the upward-facing convex surface of the intermediate section may have a continuous radius of curvature. In one option, the upward-facing convex surface of the intermediate section may have a radius from about 0.5 inch to about 0.75 inch (i.e., a diameter from about 1.0 inch to about 1.5 inch). In another option, the intermediate section may have a cross-sectional profile that is semicircular. A preferred upward-facing convex surface has a size and curvature, such as a radius, that is substantially the same or similar to the closet rod such that hangers will hang on the upward-facing convex surface of the repositionable closet bar in the same manner as they hang on the closet rod.

In some embodiments of the repositionable closet bar, the distal section may have a rectangular cross-sectional profile (i.e., width and height) and/or the proximal section may have a rectangular cross-sectional profile (i.e., width and height). The rectangular cross-section profile provides good strength to oppose the forces placed upon the repositionable closet bar while simultaneously preventing clothes hangers from sliding beyond the intermediate section in either the proximal or distal direction.

In some embodiments of the repositionable closet bar, the elongate rigid bar may have a constant width along the entire length of the elongate rigid bar and/or the elongate rigid bar may have a downward-facing surface that is flat along the entire length of the elongate rigid bar. While the elongate rigid bar may have various widths along its length and/or may have a non-flat surface over a portion of the downward-facing surface, a constant width and flat downward-facing surface along the entire length of the elongate rigid bar may be convenient for manufacturing, provide durability and strength for long term use, and create an elegant appearance.

In some embodiments of the repositionable closet bar, the elongate rigid bar may be made from or with a material selected from wood, plastic, metal, stone (such as granite), ceramic, glass and composites. In one option, the compressible gripping pads may be made with rubber, elastomers and/or other polymers or polymer composites. Non-limiting examples of elastomers, such as thermoset and thermoplastic elastomers, include ethylene propylene copolymers, epichlorohydrin, polyacrylic rubber, silicone rubber, polyurethanes, polyamides, polyvinyl chloride, polyester, and polyvinyl chloride coated polyester. The compressible gripping pads preferably have a high grip under even small compression forces. The grip provided by the compressible gripping pads may oppose or prevent the repositionable closet bar from sliding side-to-side and/or pivoting as the individual interacts with the repositionable closet bar, such as placing clothes hangers onto the intermediate section of the repositionable closet bar. One example of a material useful for the compressible gripping pads is commercially available as DYCEM (a registered trademark of Dycem Corporation). Furthermore, the compressible gripping pads may, without limitation, be secured to the elongate rigid bar with an adhesive, such as a self-stick adhesive, or by use of a staple, nail or screw. The hook is preferably made of a metal.

In some embodiments of the repositionable closet bar, the elongate rigid bar may be straight. For example, the elongate rigid bar may be formed from a straight wood board that has a substantially uniform height and width from the distal end to the proximal end. Accordingly, the convex surface of the intermediate section must be cut into the wood board from a point of interface with the proximal section to a point of interface with the distal section. For example, a router or shaper that is equipped with a roundover bit or a bullnose bit may be used to form the convex surface of the intermediate section. Other possible manufacturing techniques may also be used to form the repositionable closet bar. For example, a plastic version may be made through injection molding and a metal version may be made by casting, metal bending and/or machining.

The dimensions of the elongate rigid bar may vary, but there are limits to each dimension based upon the dimensions of the closet shelf and closet rod combination that is available in the closet. The following dimensions for the elongate rigid bar are stated for use in conjunction with the closet shelf and closet rod combination formed using a standard closet shelf bracket, such as those available as BLUE HAWK 12.8 inch shelf bracket for shelf boards up to 14 inches deep and closet rods up to 1.25 inches in diameter, which leaves a gap of about 1.25 inch between the bottom of the closet shelf and the top surface of a 1.25 inch diameter closet rod. It should be understood that the dimensions of the elongate rigid bar stated below may be modified for use with other types or sizes of closet shelf and closet rod combinations.

The length (longitudinal dimension) of the elongate rigid bar is preferably long enough to extend under the shelf at least about 6 inches and is preferably able to extend beyond a clothes hanger space of the closet rod by about 6 inches. Since a standard hanger may be about 16 inches from end-to-end (i.e., shoulder-to-shoulder), the clothes hanger space may include about 8 inches to the front and back of the closet rod. Accordingly, the longitudinal dimension of the elongate rigid bar may range from 16 to 32 inches, preferably from 22 to 28 inches, and most preferably from 24 to 26 inches.

The width (lateral dimension) of the elongate rigid bar is preferably wide enough to prevent any twisting of the elongate rigid bar under various forces applied to the repositionable closet bar during normal use, such as the hanging of clothes hangers onto the intermediate section or a person bumping up against clothes that are already hung on the intermediate section by clothes hangers. However, the elongate rigid bar is preferably not so wide as to overlap any more of the useful area of the closet rod than necessary, and the intermediate section is preferably not so wide that a hook of a clothes hanger will not fully seat or rest on the upward-facing convex surface of the intermediate section. Optionally, the distal and proximal sections could be wider than the intermediate section if desirable to increase stability. In some embodiments, the lateral dimension (width) of the elongate rigid bar may range from 1 to 1.5 inches, and preferably from 1.25 to 1.5 inches.

The height or thickness (vertical dimension) of the elongate rigid bar is preferably sufficient to provide support for heavy clothes hung on clothes hangers over the length of the intermediate section, but the vertical dimension must not be so great as to prevent the elongate rigid bar from being positioned between the bottom surface of the closet shelf and the top surface of the closet rod. Furthermore, the vertical dimension preferably allows the elongate rigid bar to be positioned between the bottom surface of the closet shelf and the top surface of the closet rod, preferably with sufficient clearance that the first and second compressible gripping pads, if any, are not damaged or pulled off as the repositionable closet bar is being placed into an operative position. Still further, the elongate rigid bar is preferably not so thick that the upward-facing surface of the distal section or the first compressible gripping pad won't engage the bottom surface of the shelf. Accordingly, the vertical dimension of the elongate rigid bar may be in a range from 0.5 to 1.25 inches, preferably from 0.5 to 1 inches, and most preferably from 0.5 to 0.75 inches.

Some embodiments of the repositionable closet bar and/or the system including a rail may include additional elements without departing from the scope of the embodiment. Such embodiments may be described in the claims using the transitional term "comprising", which is synonymous with "including," "containing," or "characterized by," and is inclusive or open-ended and does not exclude additional, unrecited elements. Some other embodiments may be limited to certain specifically stated elements and may be described in the claims using the transitional term "consisting of" to exclude any element not specifically recited. Still other embodiments may be described in the claims using the transitional phrase "consisting essentially of" to limit the scope of the embodiment to the specified elements as well as those elements that do not materially affect the basic and novel characteristic(s) of the embodiment.

Some embodiments provide a repositionable closet bar for hanging clothes consisting essentially of an elongate rigid bar, a hook, and first and second compressible gripping pads. The elongate rigid bar has a distal section, a proximal section and an intermediate section between the distal section and the proximal section, wherein the distal section has an upward-facing surface, wherein the intermediate section has an upward-facing surface that is convex across a width of the intermediate section for receiving an supporting a hook of a clothes hanger, wherein the proximal section has an upward-facing surface that extends radially outward beyond at least a portion of the convex surface of the intermediate section, and wherein the elongate rigid bar further includes a downward-facing surface. The hook extends from a proximal end of the elongate rigid bar in a longitudinal direction of the elongate rigid bar. The first compressible gripping pad is secured to the upward-facing surface of the distal section for engaging a bottom surface of a closet shelf and the second compressible gripping pad is secured to the downward-facing surface of the elongate rigid bar for engaging a top surface of a closet rod.

FIG. 1A is a top perspective view of a repositionable closet bar 10 for hanging clothes according to some embodiments. The repositionable closet bar 10 comprises an elongate rigid bar 12 having a distal section 14, a proximal section 18 and an intermediate section 16 between the distal section 14 and the proximal section 18. The distal section 14 has an upward-facing surface 24 that is flat, the intermediate section 16 has an upward-facing surface 26 that is convex across a width of the intermediate section 16, the proximal section 18 has an upward-facing surface 28 that extends radially outward beyond at least a portion of the convex surface 26 of the intermediate section 16, and a downward-facing surface 30 of the elongate rigid bar 12 includes a flat section 32. Although the repositionable closet bar 10 is not in its operative position in conjunction with a closet shelf and closet rod combination (see FIG. 2), the repositionable closet bar 10 is in the same orientation as it would be in an operative position. Accordingly, the upward-facing surfaces 24, 26, 28 are shown facing upward. For example, the upward-facing convex surface 26 is oriented to receive a hook of a clothes hanger.

The upward-facing surface 24 of the distal section 14 preferably includes a first compressible gripping pad 29 that is adhered to the upward-facing surface 24 and is positioned for engaging a bottom surface of a closet shelf. As shown, the first compressible gripping pad 29 is positioned at a distal end of the surface 24. The flat section 32 of the downward-facing surface 30 preferably includes a second compressible gripping pad 34 for engaging a top surface of a closet rod. The repositionable closet bar 10 further includes a L-shaped hook 40 that extends from the proximal end 19.

The repositionable closet bar 10 has a length (longitudinal dimension) "L", a width (lateral dimension) "W", and a height or thickness (vertical dimension) "H" as shown in FIG. 1A. In the embodiment shown, the repositionable closet bar 10 has a uniform width W and height H along the length L of the elongate rigid bar 12, although the intermediate section 16 has a upward-facing convex surface 26.

Figure 1B:
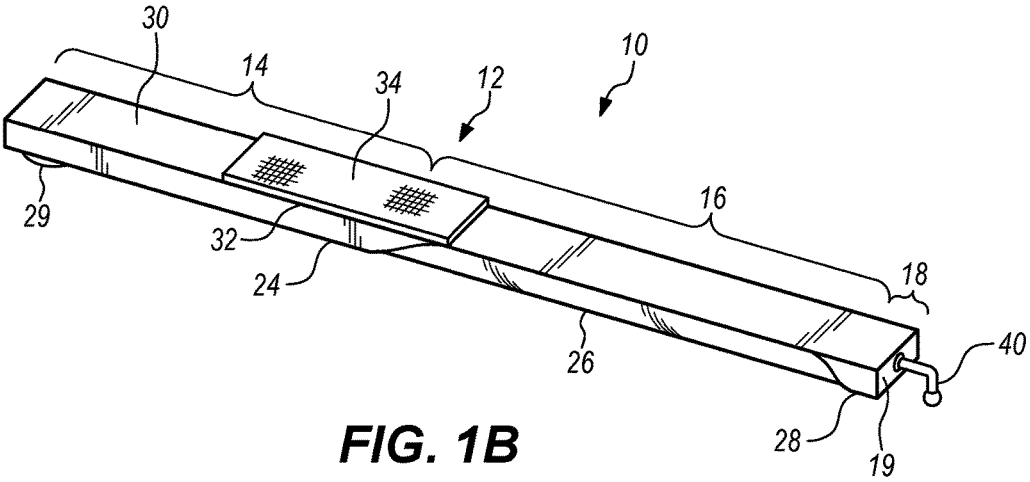
FIG. 1B is a bottom perspective view of the repositionable closet bar of FIG. 1A.

FIG. 1B is a bottom perspective view of the repositionable closet bar 10 of FIG. 1A. This view illustrates the downward-facing surface 30 and the second compressible gripping pad 34 that is adhesively secured to a flat or otherwise suitably shaped portion of the downward-facing surface 30 for engaging a top surface of a closet rod. Other reference numbers identified in FIG. 1B are the same reference numbers previously identified in reference to FIG. 1A and are duplicated in FIG. 1B for context.

Figure 1C:
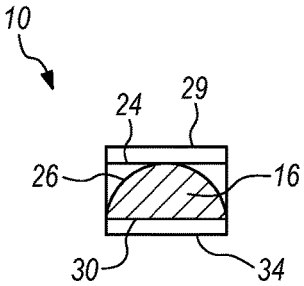
FIG. 1C is a cross-sectional diagram of an intermediate section of the repositionable closet bar of FIG. 1A.

FIG. 1C is a cross-sectional diagram of an intermediate section 16 of the repositionable closet bar 10 taken along line C-C shown in FIG. 1A. The cross-section cuts through the intermediate section 16 and shows that the intermediate section 16 has a semicircular profile. Specifically, the semicircular profile includes the downward-facing surface 30 that is flat and the upward-facing convex surface 26 that is a circular arc. Other upward-facing convex shapes may be similarly implemented. In the background of the cross-sectional cut through the intermediate section 16, FIG. 1C also shows the upward-facing surface 24 of the distal section, the first compressible gripping pad 29 that is secured to the upward-facing surface 24 of the distal section, and the second compressible gripping pad 34 that is secured to the downward-facing surface 30 of the elongate rigid bar.

Figure 1D:
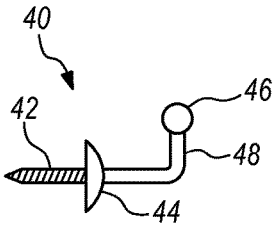
FIG. 1D is a side view of a hook that is attached to the repositionable closet bar of FIG. 1A.

FIG. 1D is a side view of a hook 40 that is attachable to the proximal end 19 of the repositionable closet bar 10 shown in FIG. 1A. The hook 40 has an L-shaped shaft 48 and has screw threads 42 for threadably securing the hook into a drilled or formed hole in the proximal end 19 of the repositionable closet bar 10. The illustrated hook 40 has a decorative stop collar 44 and a spherical tip 46 that eliminates sharp edges that could snag fabric.

Figure 2:
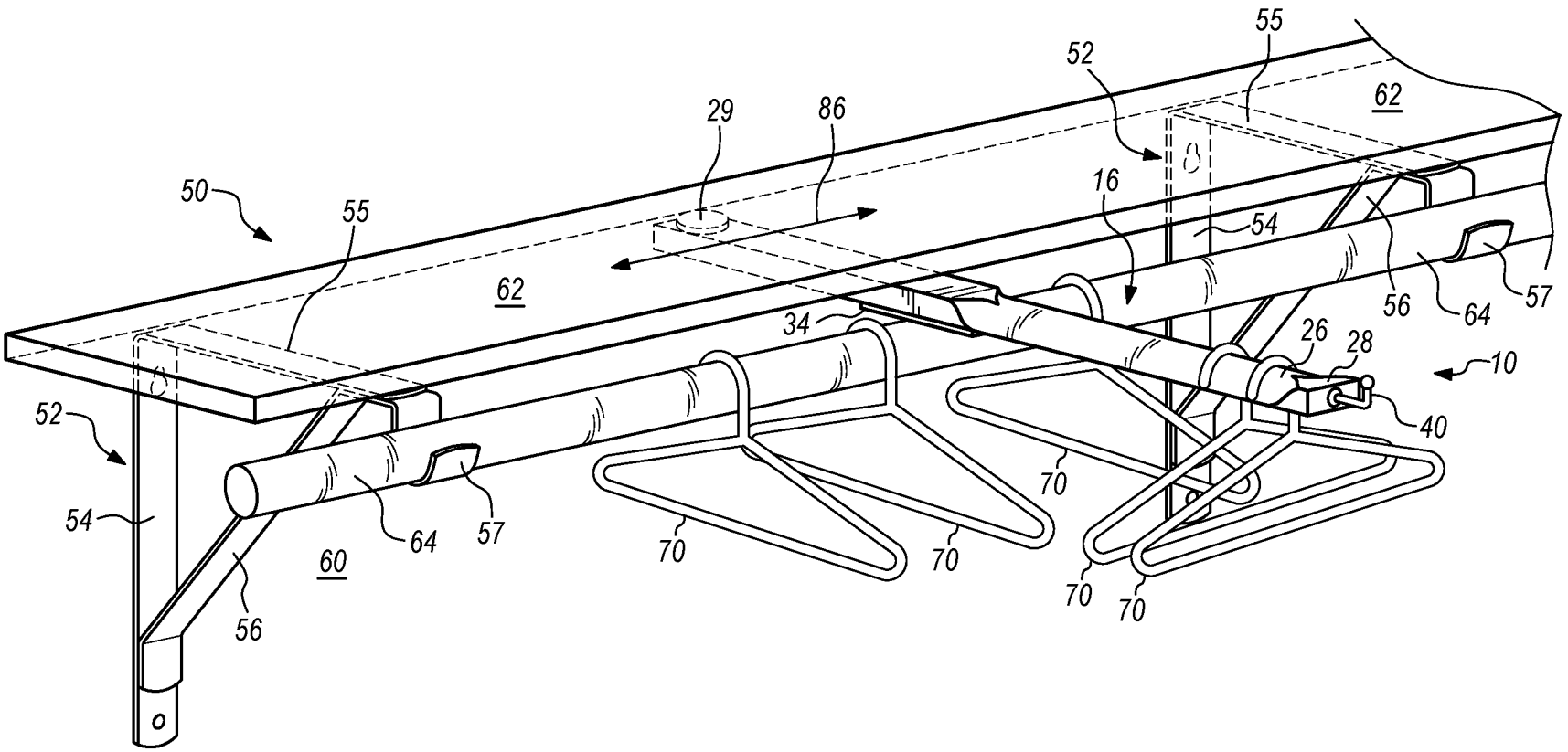
FIG. 2 is a perspective view of the repositionable closet bar in an operative position for use in conjunction with a first standard closet shelf and closet rod combination.

FIG. 2 is a perspective view of the repositionable closet bar 10 in an operative position for use in conjunction with a standard closet shelf and closet rod combination 50. The illustrated standard closet shelf and closet rod combination 50 includes a pair of brackets 52 that are each secured to a closet wall 60. Each bracket 52 includes a vertical plate 54 that is attached to the wall 60 with screws (not shown; but screwed through the bracket into studs within the wall), a horizontal plate 55 for supporting and securing the shelf 62, an angled brace plate 56 for providing support to the horizontal plate 55, and a closet rod holder 57 extending down from the horizontal plate 55. The shelf 62 lays across the two horizontal plates 55 and a closet rod 64 lays across the two closet rod holders 57. The shelf 62 is preferably secured to the two horizontal plates 55 with screws (not shown) and the closet rod 64 is preferably secured to the two closet rod holders 57 with screws (not shown). In some closet configurations, one or more ends of the shelf 62 may be supported by a shelf support board and/or one or more ends of the closet rod 64 may be supported with a simple closet rod bracket (not shown) having either an open-lip flange or closed-lip flange. Accordingly, while there is preferably at least one of the brackets 52 present to establish the standard spacing between the closet shelf and the closet rod, the number of brackets is not critical and is primarily a function of the distance that the closet shelf and closet rod extend. The standard closet shelf and closet rod combination 50 is a common feature of a closet in new home construction. Accordingly, an individual may store boxes or other items on top of the shelf 62 and may hang clothes on clothes hangers 70 from the closet rod 64 along the entire length of the closet rod 64.

The repositionable closet bar 10 is shown in an operative position with the first compressible gripping pad 29 engaging the bottom (underneath) side of the shelf 62 and the second compressible gripping pad 34 engaging the top surface or edge of the closet rod 64. In this operative position, at least a portion of the intermediate section 16 extends in a proximal direction (away from the wall 60 and toward the closet space accessible to an individual) beyond the clothes hanging space used for hanging clothes hangers 70 from the closet rod 64. Accordingly, a small number of additional hangers 70 may be received and supported on the upward-facing convex surface 26. Notice that the proximal section 18 has an upward-facing surface 28 that extends radially outward beyond at least a portion of the convex surface 26 of the intermediate section 16 such that the hangers 70 are prevented from sliding off the proximal end of the repositionable closet bar 10.

It is shown that the hangers 70 and clothes (clothes not shown) hung on the repositionable closet bar 10 may avoid interfering with the hangers 70 and clothes (clothes not shown) hung on the closet rod 64. Furthermore, the hangers 70 hung on the repositionable closet bar 10 hang parallel to the closet rod 64 and front edge of the closet shelf 62 such that clothes (not shown) hung on the repositionable closet bar 10 are front-facing (or perhaps back-facing, if desired) for optimal viewing by an individual. By contrast, clothes (not shown) hung from the hangers 70 on the closet rod 64 are sideways to the individual in the closet such that only a narrow edge of the clothes can be seen. Note that various clothing accessories, such as a belt, tie, or necklace, may also be hung from the hook 40 to hang downward in front of the hangers 70 and clothes (clothes not shown) hung on the repositionable closet bar 10.

Notice that the repositionable closet bar 10 is not fastened to the closet shelf 62 or the closet rod 64 and may be quickly and simply repositioned left or right (see double-headed arrow 86). The repositionable closet bar 10 may be repositioned by grabbing the bar at any point, such as the intermediate section, and then sliding the bar (i.e., generally translational movement) along the closet shelf 62 and the closet rod 64. Alternatively, the repositionable closet bar 10 may be repositioned by grabbing the bar at any point, withdrawing the bar from between the closet shelf 62 and closet rod 64 in its current position, and then repositioning the bar between the closet shelf 62 and closet rod 64 in a new desired position. This later alternative allows repositioning without disturbing any of the hangers hung to the left side or right side of the repositionable closet bar 10. Repositioning the repositionable closet bar 10 takes only a few seconds of time and no more effort than repositioning a clothes hanger 70 on the closet rod 64.

Figure 3A:
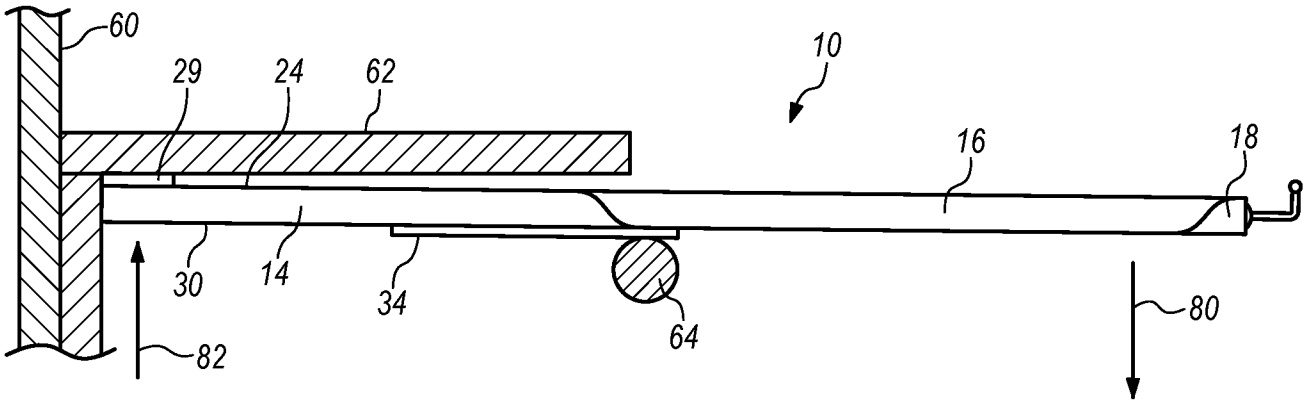
FIGS. 3A-B are side views of the repositionable closet bar in first and second operative positions relative to the standard closet shelf and closet rod combination.
Figure 3B:
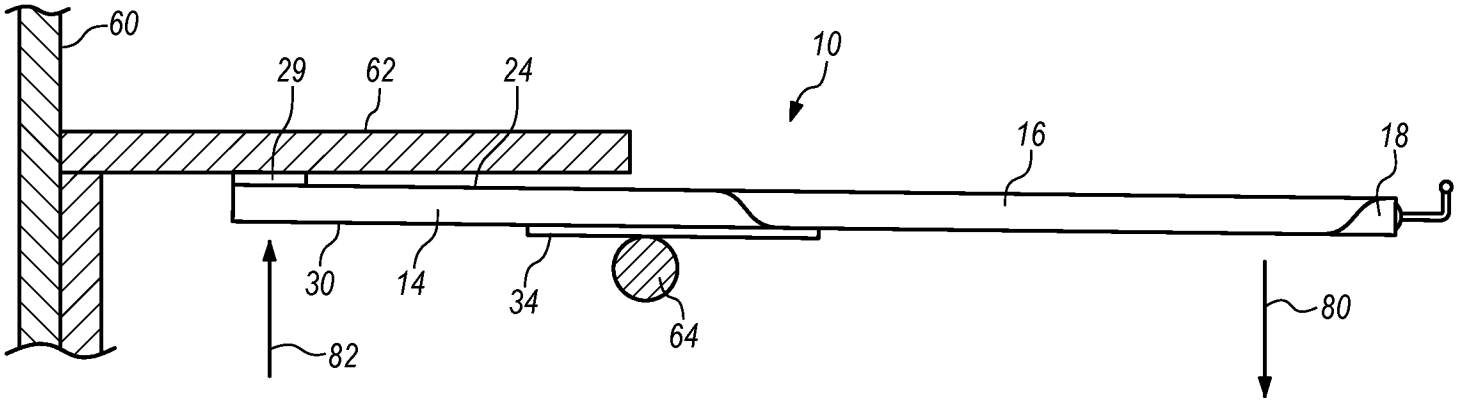

FIGS. 3A-B are side views of the repositionable closet bar 10 in first and second operative positions relative to the closet wall 60, as well as the closet shelf 62 and closet rod 64 of the standard closet shelf and closet rod combination 50 (see FIG. 2). In FIG. 3A, the repositionable closet bar 10 is shown in a first operative position as far as possible toward the back of the shelf 62 (i.e., toward the wall 60). The first compressible gripping pad 29 is secured to the upward-facing surface 24 of the distal section and engages the bottom (underneath) side of the closet shelf 62. The second compressible gripping pad 34 is secured to the downward-facing surface 30 and engages the top surface or edge of the closet rod 64. In this position, the closet rod 64 acts as a fulcrum and the repositionable closet bar 10 acts as a lever. Accordingly, hanging clothes on the intermediate section 16 applies a downward force (see arrow 80) on a proximal portion of the repositionable closet bar 10, which in turn applies an upward force (see arrow 82) on the distal section 14 and the first compressible gripping pad 29, if used. Therefore, the repositionable closet bar 10 is held in place without any fasteners or any tools.

In FIG. 3B, the repositionable closet bar 10 is shown in a second operative position that is a distance forward off the back of the shelf 62 (i.e., a distance away from the wall 60). In this second operative position, the first compressible gripping pad 29 is secured to the upward-facing surface 24 of the distal section and engages the bottom (underneath) side of the closet shelf 62 in a similar manner to the first operative position of FIG. 3A. The second compressible gripping pad 34 is secured to the downward-facing surface 30 and engages the top surface or edge of the closet rod 64 in a similar manner to the first operative position of FIG. 3A. Accordingly, the repositionable closet bar 10 is held in place without any fasteners or any tools. The primary difference between the first operative position of FIG. 3A and the second operative position of FIG. 3B is that the second operative position extends the repositionable closet bar 10 further in the proximal direction (i.e., to the right in FIGS. 3A and 3B). As a result, the second operative position makes a greater amount of the intermediate section 16 available for receiving hangers. Notice that the second compressible gripping pad 34 still engages the top of the closet rod 64, but it does so at a different point. Optionally, the repositionable closet bar 10 could be repositioned even further forward, but it is recommended that the first compressible gripping pad 29, or the distal position of the distal section 14, remain positioned under a middle portion of the closet shelf 62 for the purpose of stability and security. In a preferred option, the length and position of the second compressible gripping pad 34 on the downward-facing surface 30 may be selected to provide guidance to an individual as to how far the repositionable closet bar 10 may repositioned forward.

Figure 4:
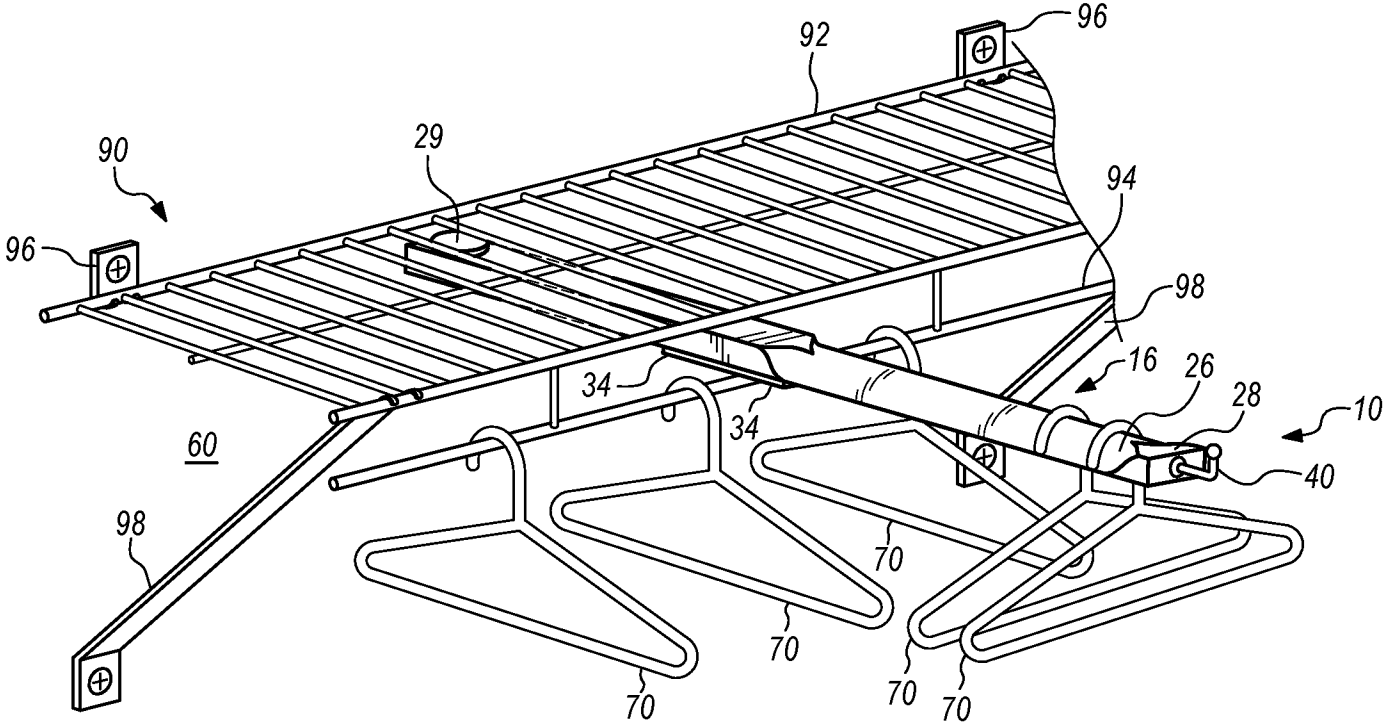
FIG. 4 is a perspective view of the repositionable closet bar in an operative position for use in conjunction with a second standard closet shelf and closet rod combination made of wire.

FIG. 4 is a perspective view of the repositionable closet bar 10 in an operative position for use in conjunction with a second standard closet shelf and closet rod combination 90 made of wire. The closet shelf is formed by an open wire shelf structure 92 and the closet "rod" is formed by a support wire 94. The open wire shelf structure 92 is supported along a back edge by plastic brackets 96 that are fastened to the wall 60 with screws and is supported along the front edge by metal braces 98 that are similarly fastened to the wall 60 with screws.

The repositionable closet bar 10 is placed in the operative position in the same manner as in reference to FIG. 2 and is repositioned in the same manner as in reference to FIGS. 2 (side-to-side) and 3A-B (front-to-back). The first compressible gripping pad 29 (as seen through the gaps between adjacent wires of the closet shelf 92) is upward facing on the distal section that extends between the closet shelf 92 and the wire support 94 and then under the shelf 92, such that the first compressible gripping pad 29 engages the bottom surface of the wires that make up the open wire shelf structure 92. The second compressible gripping pad 34 on the downward-facing surface of the repositionable closet bar 10 engages the top surface of the support wire 94 that is provided for hanging clothes hangers 70. Accordingly, the proximal section 18 of the repositionable closet bar 10 extends outward such that additional hangers 70 can be hung on an accessible portion of the upward-facing convex surface 26 of the intermediate section 16. It is a benefit of some embodiments, such as is shown in FIGS. 2 and 4 that the repositionable closet bar 10 may be used in both the first standard closet shelf and rod combination 50 (FIG. 2) and the second standard closet shelf and closet rod combination 90.

Interlocking Rail

Some embodiments provide a system comprising a rail having first and second channels for receiving first and second elongate rigid bars. The first and second elongate rigid bars may be configured according to any one or more of the foregoing embodiments of a repositionable closet bar. Furthermore, the system may be provided in the form of a kit that includes one rail and two repositionable closet bars. No tools are required to install and utilize the system. Rather, the first and second elongate rigid bars may be secured within the first and second channels of the rail using a simple insertion and rotation of the first and second elongate rigid bars. The resulting system is quite stable during use, yet easily repositionable and/or disassembled. One benefit of the system is that the two repositionable closet bars may be used independently or in combination with the rail depending upon the user's current needs.

Some embodiments provide a system comprising a rail having an elongate rail body, wherein the elongate rail body includes a perimeter edge, a first channel and a second channel. The first channel includes a first seat, a first brace, and a first passageway extending into the elongate rail body from the perimeter edge of the elongate rail body to the first seat. The first seat preferably has a first arc greater than 90 degrees. The first passageway may have a first side that is tangent to the first arc and may have a second side that is aligned with a first central axis of the first arc. The first brace has a first upwardly directed surface that extends laterally along a first radial line of the first arc of the first seat. The second channel includes a second seat, a second brace, and a second passageway extending into the elongate rail body from the perimeter edge of the rail body to the second seat. The second seat preferably has a second arc greater than 90 degrees. The second passageway may have a first side that is tangent to the second arc and may have a second side that is aligned with a second central axis of the second arc. The second brace has a second upwardly directed surface that extends laterally along a second radial line of the second arc of the second seat.

In some embodiments, the first upwardly directed surface of the first brace may be substantially colinear with the second upwardly directed surface of the second brace. Furthermore, embodiments may position the first and second seat in a lateral alignment to be supported by an elongate rigid bar at the same elevation. Specifically, two elongate rigid bars may include two intermediate sections that are interlocked with the first and second channels of the rail and then inserted between a closet shelf and closet rod as described herein to support the rail. Since the elongate rigid bars are installed at the same elevation and laterally aligned (established by the elevations of the closet shelf and the closet rod), lateral alignment of the first and second seats establishes an installed orientation of the rail.

Embodiments of the rail include an elongate rail body that forms a working area between the first and second channels. Optionally, the rail may form additional working areas on either side of the first and/or second channels. Each working area may be used to support a load caused by one or more items. However, the working area between the first and second channels is particularly stable under a load because the load will pull down on both elongate rigid bars and actually increase the stability of the system.

Embodiments of the system may include first and second elongate rigid bars configured to be positioned between a closet shelf and a closet rod in accordance with any of the disclosed embodiments of the repositionable closet bar. For example, each elongate rigid bar may include a distal section with an upward-facing surface for engaging a bottom surface of the closet shelf, a downward-facing surface for engaging a top surface of the closet rod, and an intermediate section having a semicircular cross-section that may be interconnected or interlocked with the rail. The semicircular cross-section of each elongate rigid bar may have a flat base and an upwardly facing surface having a semicircular arc.

Embodiments of the first elongate rigid bar may be moved into the first passageway with the first elongate rigid bar in a first axially rotated orientation with the flat base of the first elongate rigid bar facing the second side of the first passageway until an axis of the semicircular cross-section is in substantially the same position as an axis of the first arc of the first seat and then rotated about the axis until the first elongate rigid bar is in a second axially rotated orientation with the upwardly-facing surface of the first elongate rigid bar positioned to engage the first seat along the first arc. In both the first and second axially rotated orientations, the axis of the semicircular cross-section of the first elongate rigid bar is substantially parallel to the axis of the first arc of the first seat and remains substantially parallel during movement into the first passageway and rotation into engagement with the seat. The movement of first elongate rigid bar into and within the first passageway is preferably substantially translational. Translational motion occurs when all points of a body move uniformly in the same line or direction, including movement is rectilinear or curvilinear. The rotation of the first elongate rigid bar about its axis may involve little or no translational motion, such that the two axes remain substantially parallel. The second elongate rigid bar may be handled in the same manner as the first elongate rigid bar. Specifically, the second elongate rigid bar may be moved and rotated into a seated position with the second seat of the second channel in the same manner that the first elongate rigid bar is moved and rotated into a seated position with the first seat of the first channel.

Some embodiments include a narrow gap or "play" between the first elongate rigid bar and the first seat. Accordingly, the elongate rail body may tilt forward a few degrees under its own weight and/or under a load, but the gap or play is sufficiently small that the tilt is very minor, such as a tilt angle of less than about 10 degrees and preferably less than about 5 degrees. For example, the rail may tilt forward until both the first seat engages the upward facing surface of the first elongate rigid bar and the first brace engages the flat base of the first elongate rigid bar. To limit the tilt angle, the gap or play between the first elongate rigid bar and the first seat (with the flat base of the first elongate rigid bar engaging the first brace) or the gap or play between the first elongate rigid bar and the first brace (with the upward facing surface of the first elongate rigid bar engaging the first seat), measured in a vertical direction, is preferably no more than 5 millimeters and more preferably less than about 3 millimeters. Some embodiments may further include a similar narrow gap or "play" between the second elongate rigid bar and the second seat, and all statements regarding the gap or play between the first elongate rigid bar and first seat are equally applicable to the second elongate rigid bar and the second seat.

Some embodiments of the system may be characterized in that the first elongate rigid bar may only be removed from the first seat (i.e., moved out of engagement with the first seat) by first rotating the first elongate rigid bar about the axis of the first elongate rigid bar from the second axially rotated orientation to the first axially rotated orientation. Specifically, when the first elongate rigid bar is in full engagement with the first seat (i.e., a "seated position"), the first seat prevents any significant horizontal (left/right) translational movement of the first elongate rigid bar and any significant vertical (up/down) translational movement of the first elongate rigid bar. Furthermore, embodiments of the first elongate rigid bar may include distal and/or proximal sections that extend radially outward beyond the semicircular cross-section of the intermediate section of the first elongate rigid bar, such that the distal and/or proximal sections will not pull through the opening that forms the first seat. As a result, the first elongate rigid bar may only be moved out of engagement with the first seat by first rotating the first elongate rigid bar about the axis of the first elongate rigid bar from the second axially rotated orientation to the first axially rotated orientation and then moving the first elongate rigid bar through the first passageway. In various embodiments, the first elongate rigid bar cannot be rotated without first removing it from an installed position between the closet shelf and the closet rod because the width of the first elongate rigid bar may be greater than the distance between the closet shelf and the closet rod. It should be understood that all statements regarding moving the first elongate rigid bard out of engagement with the first seat are equally applicable to moving the second elongate rigid bar out of engagement with the second seat.

Some embodiments of the first and second brace may extend laterally. For use in combination with an elongate rigid bar that has a flat base or bottom surface, a laterally extending brace may engage (contact) the flat base over the lateral dimension of the brace. A greater extent of engagement between the brace and the elongate rigid bar may stabilize the connection (oppose wobbling) between the rail and the elongate rigid bar. In one option, the first brace may extend in a first lateral direction from the first central axis and the second brace extends laterally in a second lateral direction from the second central axis, and wherein the first lateral direction is opposite the second lateral direction. For example, the first brace may extend in a lateral direction to the right and the second brace may extend in a lateral direction to the left, or vice versa.

Embodiments of the first and/or second passageway may have first and second sides that are substantially parallel for receiving the intermediate section of the elongate rigid bar with the elongate rigid bar in a first axially rotated orientation, and wherein the arc of the seat receives the semicircular cross-sectional profile of the intermediate section with the elongate rigid bar in a second axially rotated orientation. The first axially rotated orientation may be an orientation that allows the elongate rigid bar to move sideways through the passageway. For example, the elongate rigid bar may have an intermediate section with a semicircular cross-sectional profile, such that the intermediate section has a width that is twice the height because the height is equal to the radius of the semicircle and the width is equal to the diameter (i.e., twice the radius). Accordingly, if the first axially rotated orientation positions the flat base of the semicircular intermediate section parallel with an axis of the passageway, then the passageway may be only slightly wider than the radius of the intermediate section of the elongate rigid bar. While the passageway may be oversized to be any amount greater than the radius, the strength of the rail and, more particular, the strength of the brace is improved if the passageway is kept to a minimum width. Conversely, the strength of the brace may increase with increasing length of the passageway albeit with the possibility of decreasing the strength of the rail. Accordingly, it may be optimal to position the seat near the vertical center of the rail so that neither the strength of the brace nor the strength of the rail is compromised.

In some embodiments, the first and/or second passageway may extend into the elongate rail body from a lower edge of the rail body to a corresponding one the seats. The passageway may extend in a vertical direction to the seat or at an angle relative to the vertical direction. Optionally, the upwardly facing surface of the brace may be substantially horizontal and the passageway may extend in a substantially vertical direction. For example, the first and second sides of the passageway may be substantially perpendicular to the first upwardly directed surface of the first brace.

In some embodiments, the first and/or second elongate rigid bar may have a semicircular cross-section with a radius that is substantially equal to a radius of the corresponding seat. The amount of contact between the elongate rigid bar and the seat may be its greatest when the elongate rigid bar and the seat have substantially the same radius. However, a small gap or play may be desirable to prevent small deviations in dimensions from causing the elongate rigid bar to become lodged before reaching a fully seated position. In one option, the upward facing surface of the brace may be positioned (offset) slightly lower, perhaps 1-3 millimeters lower, than a lateral radial line of the arc of the seat. In a similar option, the passageway may be widened by positioning (offsetting) a first side of the passageway slightly out of alignment with the axis of the arc of the seat and/or by positioning (offsetting) a second side of the passageway slightly outward from a line that is tangent to the arc of the seat. Ideally, the passageway and seat have dimensions that are slightly greater than necessary to move the elongate rigid bar therethrough and into a seated position, but not so great as to cause significant wobbling and/or significant tilting one the elongate rigid bar is seated. A gap or play of about 1-3 millimeters may be optimal.

Some embodiments of the rail have a thickness from 0.25 inch to 1 inch, preferably greater than 0.5 inch, and more preferably from 0.5 inch to 0.75 inch. The thickness of the rail also plays a role in determining or limiting the tilt angle of the rail for any given amount of gap or play between the elongate rigid bars and their respective seats.

In some embodiments, the working area of the rail may secure a plurality or set of hooks, secure a plurality or set of pegs or pins, and/or include a plurality or set of holes from the front to the back of the rail. For example, a plurality of hooks may be adapted for clothes, towels, jewelry, belts, purses and the like. Pegs and/or pins may be adapted for hanging ties, jewelry, race medals, and other items. A plurality of holes may be used, for example, to receive scarves. The hooks, pegs, pins, and/or holes may any size or shape. One example of a hook is a double hook that has an upper prong and a lower prong. Other features, hardware, or configurations may be included in the working areas of the rail where they won't interfere with the use of the channels. For example, a plurality of recesses may be formed in an upwardly directed edge of the rail, such as to facilitate hanging an "over-the-door" type organizer or mirror. Still further, the rail may support a light bar either on the front or the back of the rail.

In some embodiments, the system may further include a second rail that is substantially the same as the first rail. Accordingly, both the first and second rails may be secured to the same first and second elongate rigid bars to form a unique and extremely stable structure. For example, the first and second rails may be used to supper an upper rim or feature of a hamper, where the hamper hangs between the first and second rails and the first and second elongate rigid bars. Alternatively, the first and second rails may each include a working area that secures a plurality or set of hooks, secure a plurality or set of pegs or pins, and/or include a plurality or set of holes from the front to the back of the rail.

Embodiments of the system may include any of the disclosed embodiments of the repositionable closet bar. For example, the first and second elongate rigid bars (of first and second repositionable closet bars) may be configured to be repositioned side-to-side between the closet shelf and the closet rod and may be configured to be repositioned in a forward direction or a rearward direction between the closet shelf and the closet rod, and wherein, when in use, no portion of the first and second elongate rigid bars are fastened to the closet shelf and no portion of the first and second elongate rigid bars are fastened to the closet rod. Furthermore, the elongate rigid bars may further include, without limitation, a compressible gripping pad secured to the upward facing surface of the distal section and/or a compressible gripping pad secured to the downward facing surface of the elongate rigid bar. Optionally, the first and second elongate rigid bars may each have a height from 0.5 to 1.25 inches, a width from 1 to 1.5 inches, and a length from 16 to 32 inches.

Embodiments of the elongate rigid bars and the rail are not limited to any particular material. For example, the elongate rigid bars and/or the rail may be made from a material independently selected from a wood board, metal, plastic, a composite material, and/or medium-density fibreboard (MDF).

Figure 5A:
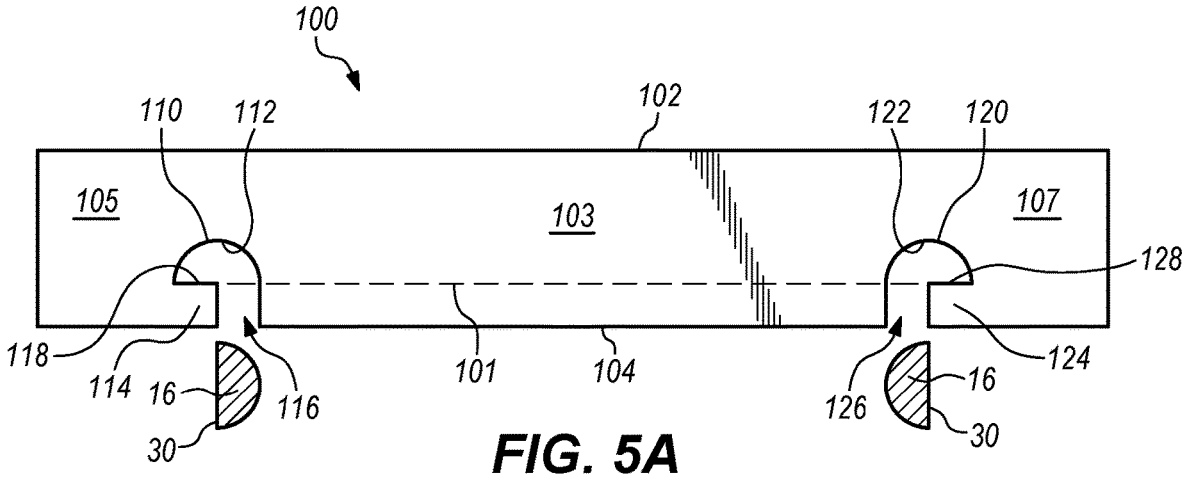
FIG. 5A is a front view of a rail have a pair of channels in which a pair of repositionable closet bars may be received.

FIG. 5A is a front view of a rail 100 have a pair of channels 110, 120 that receive the semicircular intermediate sections 16 of a pair of elongate rigid bars 12, which are the primary component of the repositionable closet bars 10 (see FIGS. 1 to 4). The rail 100 has an elongate rail body 102, wherein the elongate rail body 102 includes a perimeter edge 104, a first channel 110 and a second channel 120. The first channel 110 includes a first seat 112, a first brace 114, and a first passageway 116 extending into the elongate rail body 102 from the perimeter edge 104 of the elongate rail body 102 to the first seat 112. Furthermore, the first brace 114 has a first upwardly directed surface 118. Similarly, the second channel 120 includes a second seat 122, a second brace 124, and a second passageway 126 extending into the elongate rail body 102 from the perimeter edge 104 of the rail body 102 to the second seat 122. The second brace 124 has a second upwardly directed surface 128 that extends laterally.

The first upwardly directed surface 118 of the first brace 114 may be substantially colinear (see dashed line 101) with the second upwardly directed surface 128 of the second brace 124. Furthermore, embodiments may position the first seat 112 and the second seat 122 in a lateral alignment to be supported by first and second elongate rigid bars (see intermediate sections 16) at the same elevation. Specifically, two elongate rigid bars may include two intermediate sections 16 that are interlocked with the first and second channels 110, 120 of the rail 100 and then inserted between a closet shelf and closet rod as described herein to support the rail. Since the elongate rigid bars are installed at the same elevation and laterally aligned (established by the elevations of the closet shelf and the closet rod), lateral alignment of the first and second seats establishes an installed orientation of the rail.

The elongate rail body 102 that forms a working area 103 between the first and second channels 110, 120. Optionally, the rail may form additional working areas 105, 107 on either side of the first and/or second channels. Each working area may be used to support a load caused by one or more items. However, the working area 103 between the first and second channels is particularly stable under a load because the load will pull down on both elongate rigid bars and actually increase the stability of the system.

In preparation to move the semicircular intermediate section 16 into each of the channels 110, 120, the semicircular intermediate section 16 is positioned in a first axial orientation with the downward-facing surface 30 generally aligned with the side of the passageways 116, 126 that is formed by the respective braces 114, 124.

Figure 5B:
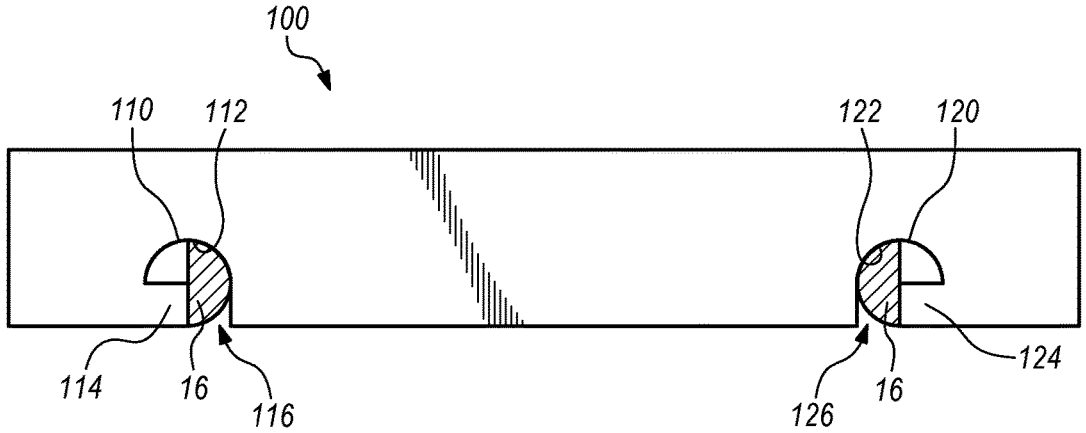
FIG. 5B is a front view of the rail after the pair of repositionable closet bars have been aligned as in FIG. 5A and received within the pair of channels in the rail.

FIG. 5B is a front view of the rail 100 after the pair of repositionable closet bars (see semicircular intermediate sections 16) have been aligned as in FIG. 5A and received within the pair of channels 110, 120 in the rail 100. Specifically, the semicircular intermediate sections 16 of the elongate rigid bars have been moved into the first and second passageways 116, 126 with each elongate rigid bar in a first axially rotated orientation (as shown) with the flat base or downward-facing surface 30 of the first elongate rigid bar facing the side of the first and second passageways formed by the braces 114, 124. The semicircular intermediate sections 16 may be moved into the passageways as far as they will go before engaging the first and second seats 112, 122, respectively.

Figure 5C:
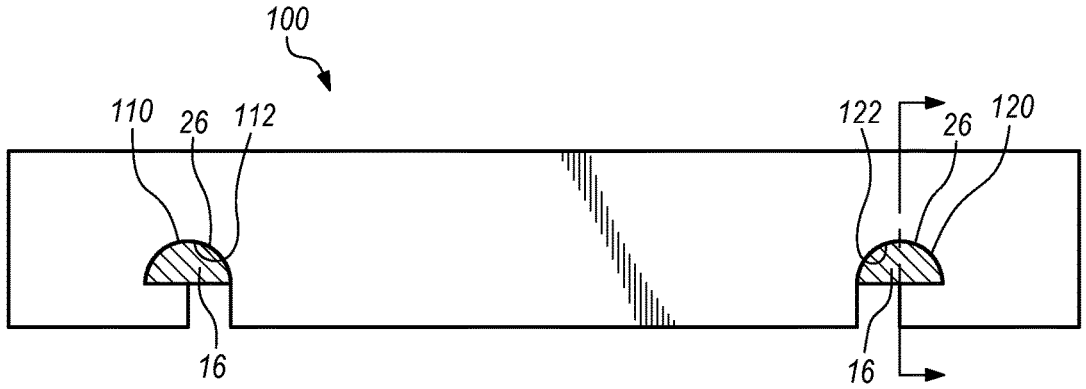
FIG. 5C is a front view of the rail after the pair of repositionable closet bars have been received as in FIG. 5B and then rotated into a seated position.

FIG. 5C is a front view of the rail 100 after the pair of repositionable closet bars (see semicircular intermediate sections 16) have been received into the passageways 116, 126 as in FIG. 5B and then rotated. In the configuration of FIG. 5C, the semicircular intermediate sections 16 are rotated in opposite directions. Specifically, the semicircular intermediate section 16 in the first passageway 116 is rotated counterclockwise about its axis (central point of the flat base) and the semicircular intermediate section 16 in the second passageway 126 is rotated clockwise about its axis (central point of the flat base). Accordingly, the first and second elongate rigid bars have each reached a second axially rotated orientation with the upwardly facing surface 26 of the first and second elongate rigid bars (see semicircular intermediate sections 16) positioned to engage the first seat 112 and the second seat 122, respectively.

Figure 5D:
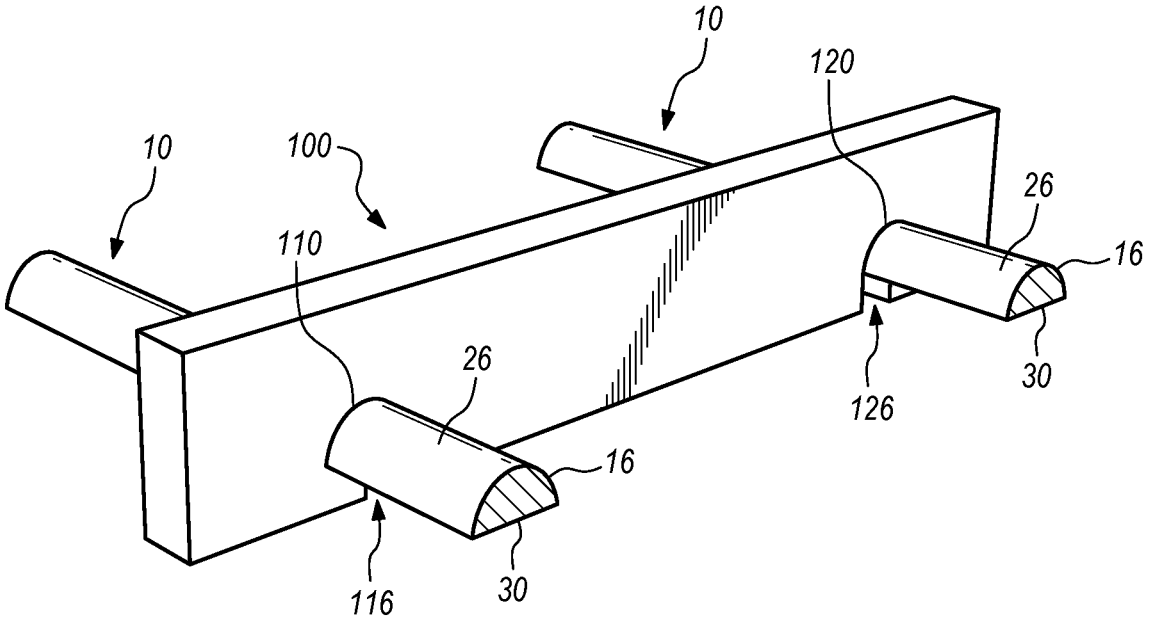
FIG. 5D is a perspective view of the rail interlocked to the pair of repositionable closet bars to support the rail in an operative position.

FIG. 5D is a perspective view of the rail 100 interlocked to the pair of repositionable closet bars 10 (see semicircular intermediate sections 16) to support the rail 100 in an operative position. In the operative position, the pair of repositionable closet bars 10 may have a distal section extending between a closet shelf 62 and closet rod 64 as shown in FIG. 2. Accordingly, the semicircular intermediate sections 16 of those repositionable closet bars 10 are generally laterally aligned at the same elevation with the downwardly facing surfaces 30 being parallel to an existing closet rod 64 upon which they are supported (See FIG. 2)

Figure 5E:
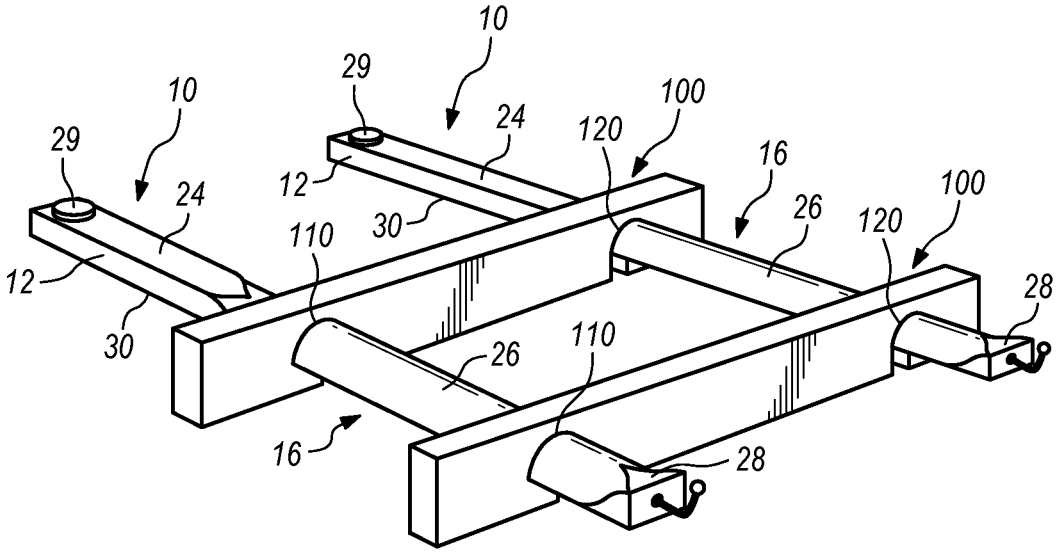
FIG. 5E is a perspective view of first and second rails interlocked to the pair of repositionable closet bars to support the first and second rails in an operative position.

FIG. 5E is a perspective view of first and second rails 100 interlocked to the pair of repositionable closet bars 10 to support the first and second rails 100 in an operative position. The presence of the first and second rails 100 interlocked to the intermediate sections 16 of the repositionable closet bars 10 does not change the manner in which the repositionable closet bars 10 are supported by either of the first and second closet shelf and closet rod systems 50, 90 (see FIGS. 2 and 4). For example, each elongate rigid bar 12 may include a distal section with an upward-facing surface 24 for engaging a bottom surface of the closet shelf, a downward-facing surface 30 for engaging a top surface of the closet rod, and an intermediate section 16 having a semicircular cross-section that may be interconnected or interlocked with the rail(s) 100. The semicircular cross-section 16 of each elongate rigid bar 12 may have a flat base and an upwardly facing surface having a semicircular arc. Optionally, the two rails 100 and/or the two repositionable closet bars 10 may support one or more objects, such as a hamper for receiving dirty laundry. Alternatively, each of the rails 100 may have their own set of hooks, pegs, pins, holes and the like.

Figure 6:
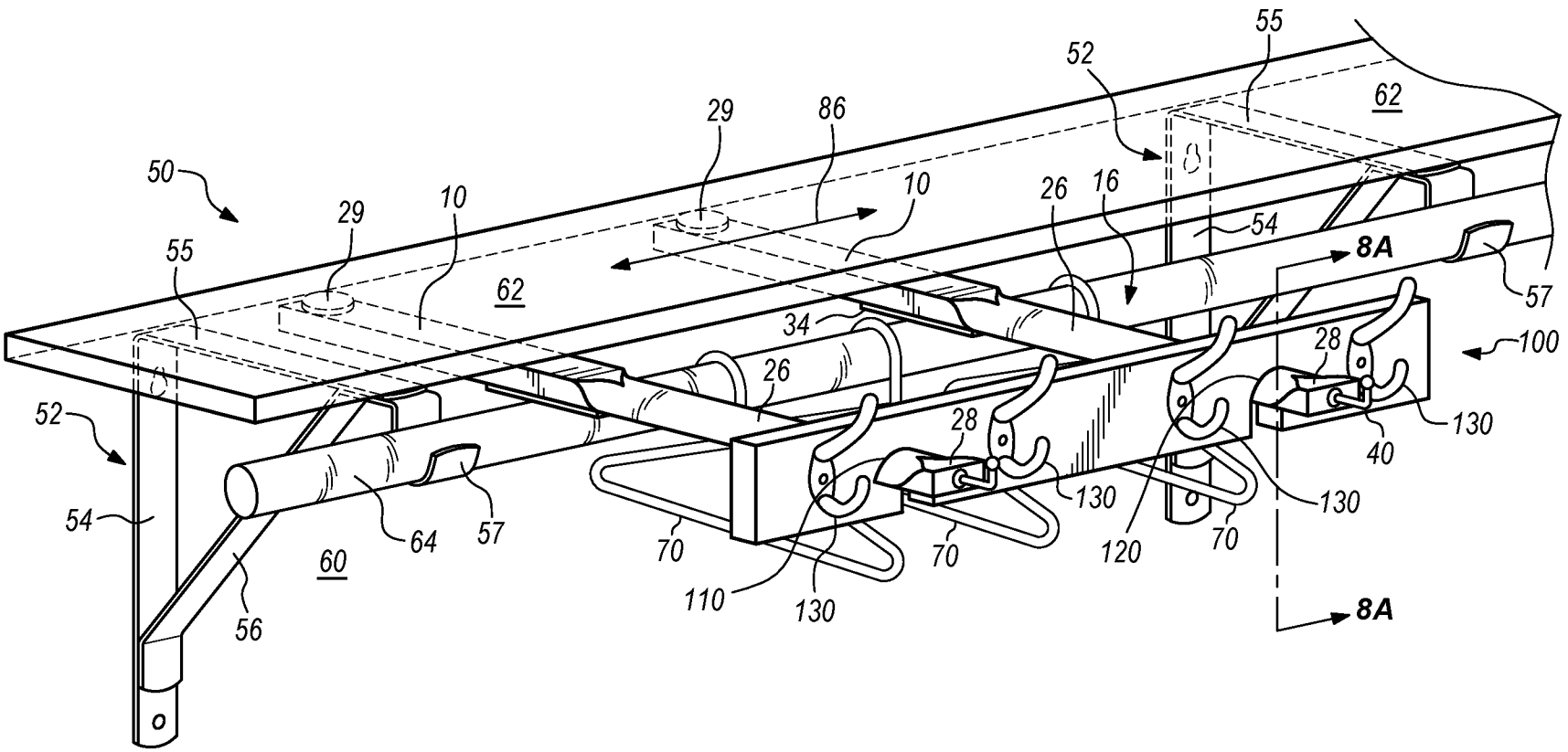
FIG. 6 is a perspective view of the rail in an operative position supported by the pair of repositionable closet bars for use in conjunction with a first standard closet shelf and closet rod combination.

FIG. 6 is a perspective view of the rail 100 in an operative position supported by the pair of repositionable closet bars 10 for use in conjunction with a first standard closet shelf and closet rod combination 50. The first standard closet shelf and closet rod combination 50 is described in detail in reference to FIG. 2 and like numerals are used here to refer to like components as shown in FIG. 2. However, first and second repositionable closet bars 10 are each shown in an operative position with the first compressible gripping pad 29 engaging the bottom (underneath) side of the shelf 62 and the second compressible gripping pad 34 engaging the top surface or edge of the closet rod 64. In this operative position, at least a portion of the intermediate section 16 extends in a proximal direction (away from the wall 60 and toward the closet space accessible to an individual) beyond the clothes hanging space used for hanging clothes hangers 70 from the closet rod 64. Accordingly, the rail 100 may be supported in a position forward of the clothes hanging space and a small number of additional hangers 70 may also be received and supported on the upward-facing convex surface 26. In the operative position of the rail 100, various clothing and/or personal items may be hung on any one or more of the hooks 130 and any such items may hang down in front of the hanging space where clothes are hung on hangers 70 from the closet rod 64. In addition, a rail 100 includes a first channel 110 secured to the first repositionable closet bar 10 (on the left) and a second channel 120 secured to the second repositionable closet bar 10 (on the right). Notice that the proximal section 18 has an upward-facing surface 28 that extends radially outward beyond at least a portion of the convex surface 26 of the intermediate section 16 such that the rail 100 is prevented from sliding off the proximal end of the repositionable closet bar 10.

Optionally, an entire system or assembly including the rail 100 and the two repositionable closet bars 10 may be repositionable with or without disconnecting the repositionable closet bars 10 from the rail 100. In another option it is possible to simply grab the rail 100 to reposition the entire system or assembly since the repositionable closet bars 10 are interlocked into the channels 110, 120 of the rail 100. As shown in FIGS. 2 and 4, the repositionable closet bars may be used with standard closet shelf and rails systems made with wood (FIG. 2) and wire (FIG. 4).

Figure 7B:
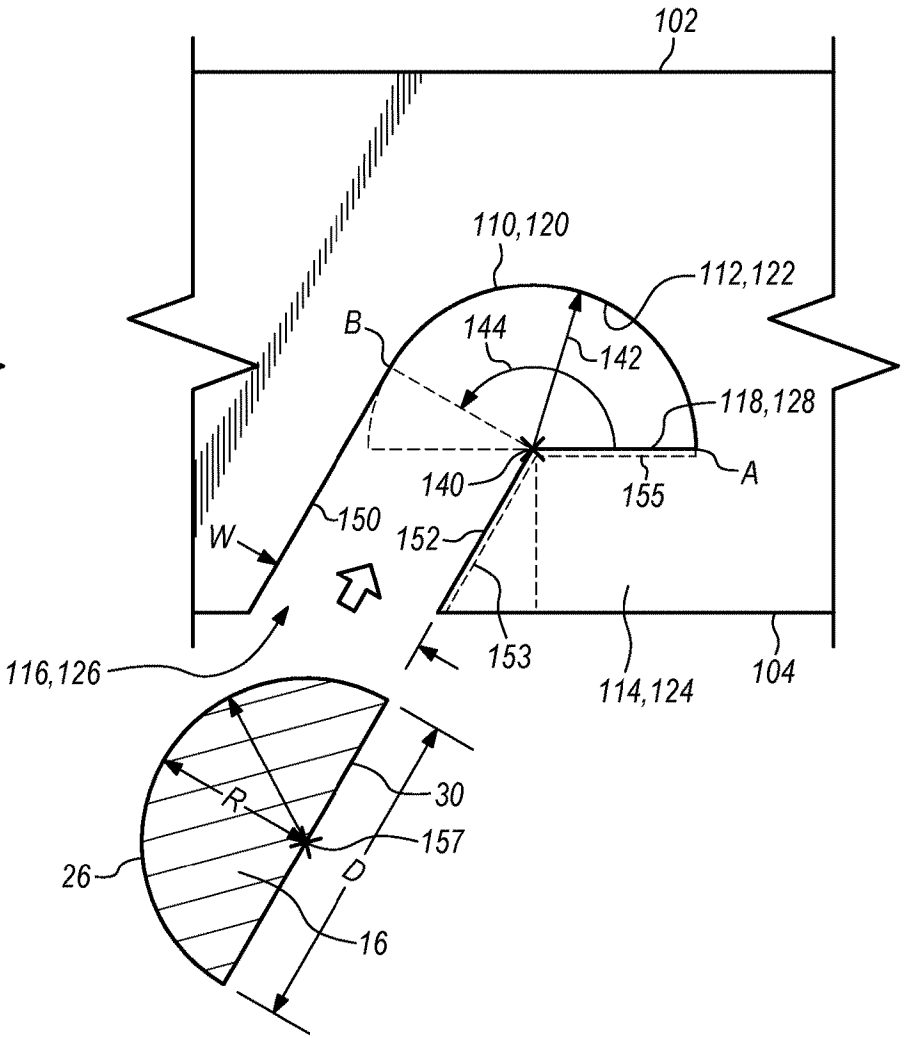
FIG. 7B is a schematic plan view of a repositionable closet bar aligned with a channel in the rail according to another embodiment.
Figure 7A:
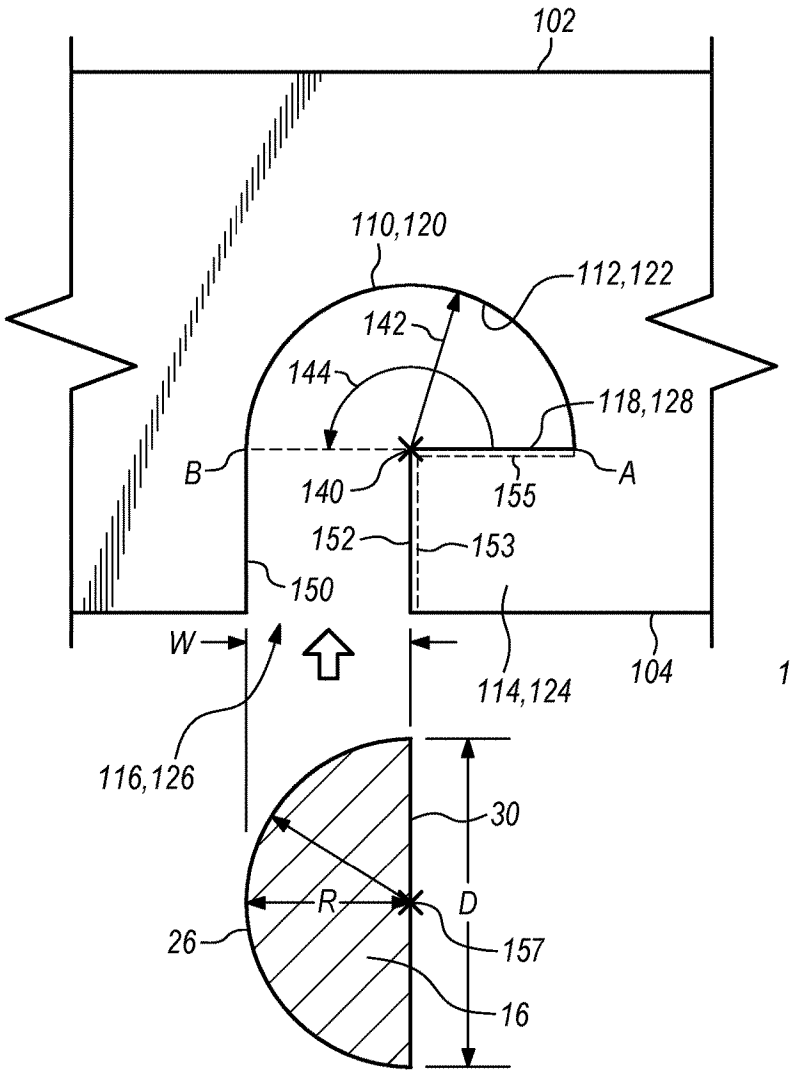
FIG. 7A is a schematic plan view of a repositionable closet bar aligned with a channel in the rail according to one embodiment.

FIG. 7A is a schematic plan view of the intermediate section 16 of a repositionable closet bar aligned with a first configuration of the channel 110, 120 in the rail 100 according to one embodiment. It should be recognized that the geometry of the illustrated channel 110, 120 may be representative of either or both channels as viewed from a front of the rail 100 and/or a back of the rail 100. So, one or more of the channels may be the reverse of the channel shown.

The seat 112, 122 preferably has an arc greater than 90 degrees. The illustrated arc has an axis 140, a constant radius 142, and the arc extends about 180 degrees (see arrow 144) around the axis from point A to point B. The passageway 116, 126 has a first side 150 that is tangent to the arc of the seat 112, 122 and may have a second side 152 that is aligned with the axis 140 of the arc of the seat. The brace 114, 124 has a first upwardly directed surface 118, 128 that extends laterally along a radial line of the arc of the seat 112, 122.

It is important that the passageway 116, 126 have a width ("W") that allows the intermediate section 16 of the repositionable closet bar to move therethrough. The intermediate section 16 of the repositionable closet bar has a surface 30 that may be the flat base of a semicircle cross-section and a surface 26 that may be the semicircular arc of the semicircular cross-section. Accordingly, the semicircular cross-section has a height dimension that is equal to the radius ("R") and a length along the flat base surface 30 that is equal to the diameter ("D"). Width W of the passageway 116, 126 must be slightly greater than the radius R of the intermediate section 16. For this purpose, the second side 152 of the passageway 116, 126 may be slightly offset from alignment with the axis 140 of the arc of the seat 112, 122 to make the passageway wider. For example, the second side 152 may be slightly offset, such as about 1 to 4 millimeters, as indicated by the dashed line 153. Similarly, it is also important that the seat 112, 122 and the upwardly directed surface 118, 128 of the brace 114, 124 allow the intermediate section 16 to move fully into a seated position. Accordingly, the upwardly directed surface 118, 128 may be slightly offset from the radial line of the arc, such as being offset by about 1 to 4 millimeters as indicated by the dashed line 155. Optionally, the radius 142 of the seat may be slightly greater than the radius of the intermediate section 16.

As previously described, the semicircular intermediate section 16 of the elongate rigid bars may be moved into the passageway 116, 126 with the elongate rigid bar in a first axially rotated orientation (as shown) with the flat base or downward-facing surface 30 of the elongate rigid bar facing the side 152 of the passageway formed by the brace 114, 124 until an axis 157 of the semicircular intermediate section 16 is in substantially the same position as an axis 140 of the arc of the seat 112, 122 (see also FIG. 5B). Subsequently, the elongate rigid bar may be rotated to cause rotation of the intermediate section 16 about the axis 157 until the first elongate rigid bar is in a second axially rotated orientation (i.e., the operative position of the repositionable closet bar) with the upwardly facing surface 26 of the elongate rigid bar positioned to engage the seat 110, 120 along the arc. In both the first and second axially rotated orientations, the axis 157 of the semicircular cross-section 16 of the elongate rigid bar is substantially parallel to the axis 140 of the arc of the seat 112, 122 and remains substantially parallel during movement into the passageway 116, 126 and rotation into engagement with the seat 112, 122. The movement of elongate rigid bar into and within the passageway is preferably substantially translational. Translational motion occurs when all points of a body move uniformly in the same line or direction, including movement is rectilinear or curvilinear. The rotation of the elongate rigid bar about its axis 157 may involve little or no translational motion, such that the two axis 157, 140 remain substantially parallel and substantially in alignment.

FIG. 7B is a schematic plan view of the intermediate section 16 of a repositionable closet bar aligned with a second configuration of the channel 110, 120 in the rail 100 according to another embodiment. It should be recognized that the geometry of the illustrated channel 110, 120 may be representative of either or both channels as viewed from a front of the rail 100 and/or a back of the rail 100. So, one or more of the channels may be the reverse of the channel shown. Furthermore, the principles and consideration for the second configuration of the channel 110, 120 is substantially the same as that of the first configuration illustrated in FIG. 7A. However, the channel 110, 120 in FIG. 7B has been placed at an angle of about 30 degrees from vertical, which causes the arc of the seat 112, 122 from point A to point B to be less than 180 degrees (see arrow 144) and may slightly reduce the amount of contact between the intermediate section 16 and the seat 112, 122. Still, the intermediate section 16 may be translationally moved into the passageway 116, 126 until it engages the seat 112, 122 and then rotated about the axis 157 to reach a fully seated position.

Figure 8A:
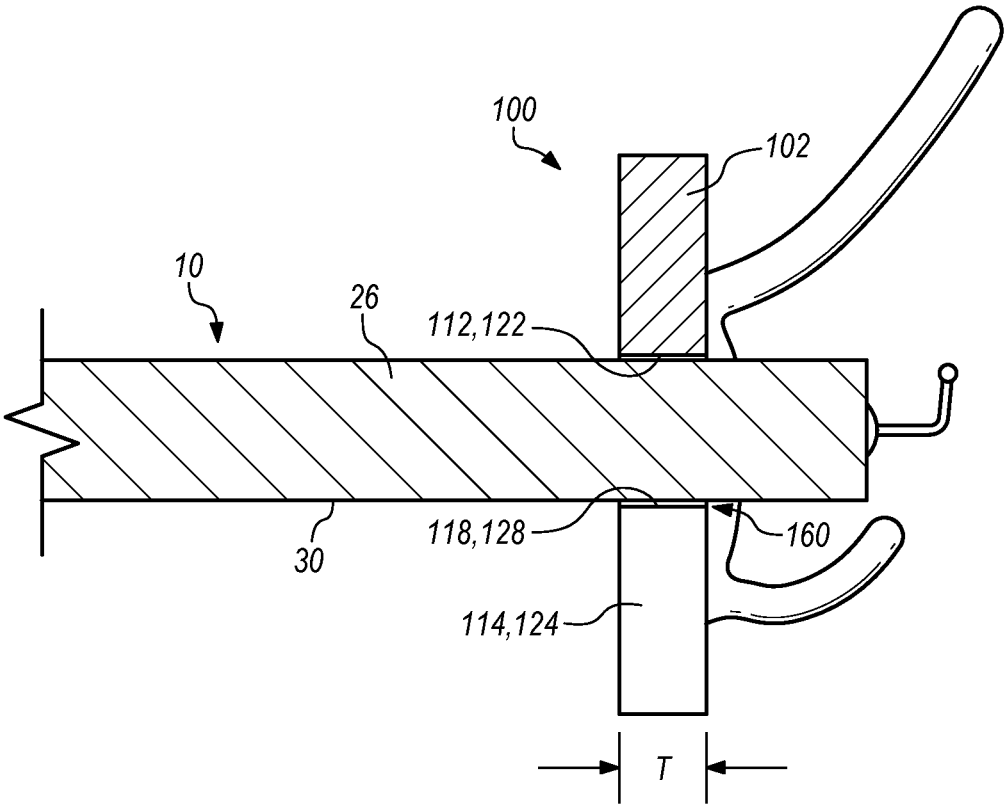
FIG. 8A is a cross-sectional side view of a repositionable closet bar seated in the channel of the rail.

FIG. 8A is a cross-sectional side view of a repositionable closet bar 10 with the semicircular upward facing surface 26 of the intermediate section seated for engagement with the seat 112, 122 of the rail 100 (see cross-sectional line 8A-8A in FIG. 6). With the elongate rail body 102 in an upright position and the semicircular upward facing surface 26 engaging the seat 112, 122, there may be a small gap 160 between the downward directed surface 30 of the repositionable closet bar 10 and the upward directed surface 118, 128 of the brace 114, 124.

Figure 8B:
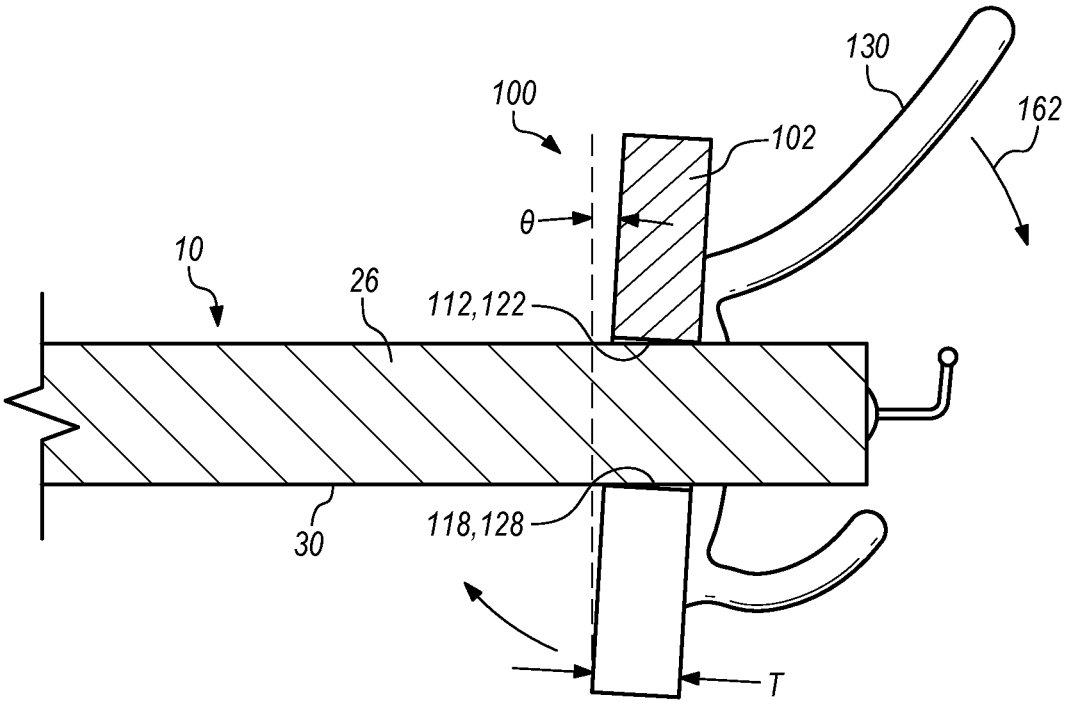
FIG. 8B is a schematic plan view of a repositionable closet bar seated and tilted forward in the channel of the rail.

FIG. 8B is a cross-sectional side view of the repositionable closet bar 10 still seated in the seat 112, 122, but now the rail 100 is tilted forward. For example, under the weight of the hooks 130 and/or items hung from the hooks 130, a rotational force 162 causes the rail 100 to tilt forward (clockwise in FIGS. 8A and 8B). The extent of the tilt angle ("0") is primarily a function of the size of the gap 160 shown in FIG. 8A and the thickness ("T") of the rail 100. Accordingly, the rail 100 will rock forward until a front edge of the seat 112, 122 of the rail 100 engages the semicircular upward facing surface 26 of the intermediate section and a back edge of the upward directed surface 118, 128 of the brace 114, 124 engages the downward directed surface 30 of the repositionable closet bar 10. Keeping the gap 160 to a dimension of between 1 and 5 millimeters, and more preferably between 1 and 3 millimeters, may cause less than a 10-degree tilt angle with a rail 100 having a thickness T of at least 0.5 inch.

Figure 9A:
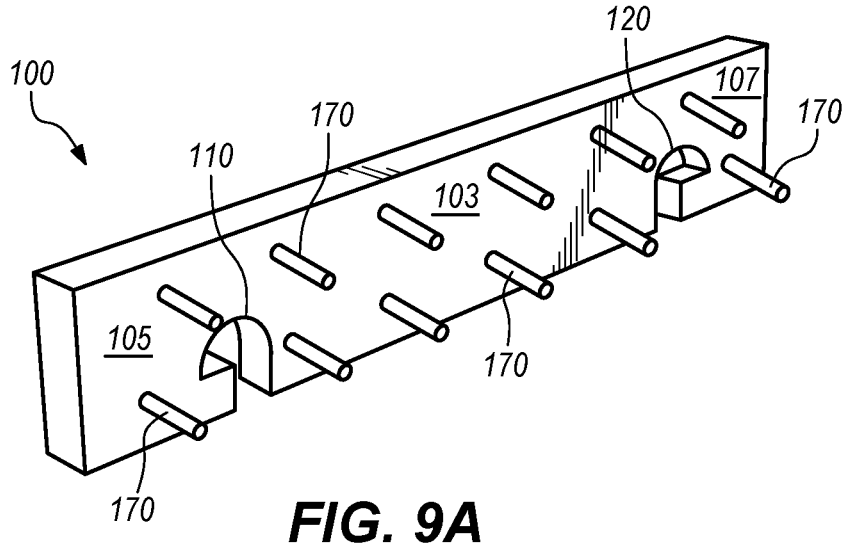
FIGS. 9A-C are perspective views of a rail having a working area securing a set of pegs, a working area including a set of holes, and an upper edge including a pair of recesses, respectively.
Figure 9B:
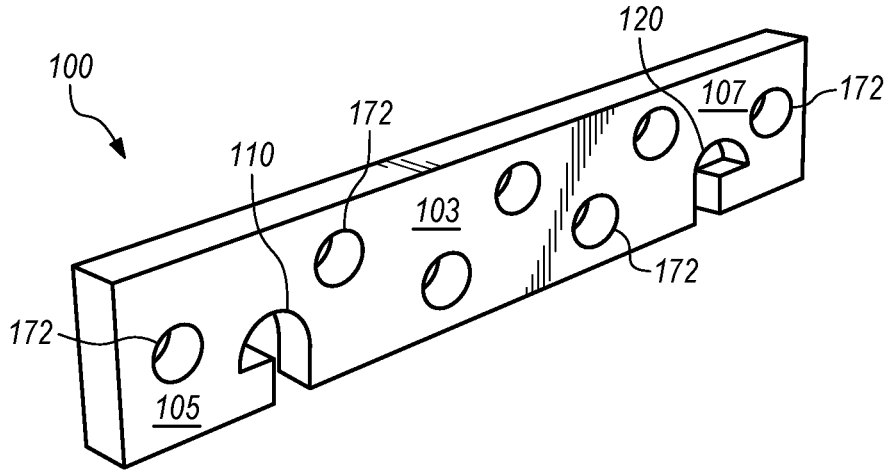
Figure 9C:
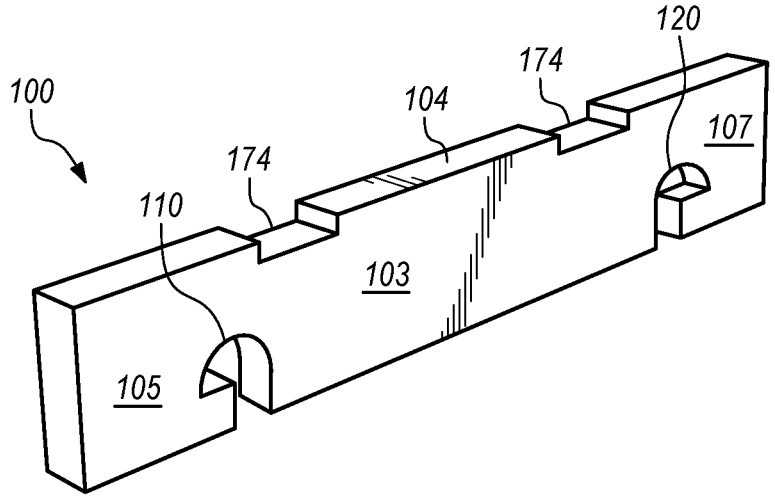

FIGS. 9A-C are perspective views of a rail 100 having working areas 103, 105, 107 securing a set of pegs or pins 170 (FIG. 9A), working areas 103, 105, 107 including a set of holes 172 (FIG. 9B), and an upper perimeter edge 104 including a pair of recesses 174 (FIG. 9C), respectively. For example, a plurality of hooks 130 (FIG. 6) may be adapted for clothes, towels, jewelry, belts, purses and the like. Pegs and/or pins 170 (FIG. 9A) may be adapted for hanging ties, jewelry, race medals, and other items. The plurality of holes 172 (FIG. 9B) may be used, for example, to receive scarves. The hooks, pegs, pins, and/or holes may any size or shape. One example of a hook is a double hook that has an upper prong and a lower prong. Other features, hardware, or configurations may be included in the working areas of the rail where they won't interfere with the use of the channels. For example, a plurality of recesses 174 (FIG. 9C) may be formed in an upwardly directed edge of the rail, such as to facilitate hanging an "over-the-door" type organizer or mirror. Still further, the rail may support a light bar either on the front or the back of the rail. Embodiment may have similar working areas on the front, back and/or edges of the rail 100 without limitation.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A system, comprising:

a rail having an elongate rail body, wherein the elongate rail body includes a perimeter edge, a first channel and a second channel;

the first channel including a first seat, a first brace, and a first passageway extending into the elongate rail body from the perimeter edge of the rail body to the first seat, wherein the first seat has a first arc greater than 90 degrees, wherein the first passageway has a first side that is substantially tangent to the first arc and a second side that is substantially aligned with a first central axis of the first arc, and wherein the first brace has a first upwardly directed surface that extends substantially laterally along a first radial line of the first arc of the first seat;

the second channel including a second seat, a second brace, and a second passageway extending into the elongate rail body from the perimeter edge of the rail body to the second seat, wherein the second seat has a second arc greater than 90 degrees, wherein the second passageway has first side that is substantially tangent to the second arc and a second side that is substantially aligned with a second central axis of the second arc, and wherein the second brace has a second upwardly directed surface that extends substantially laterally along a second radial line of the second arc of the second seat;

wherein the first upwardly directed surface of the first brace is substantially colinear with the second upwardly directed surface of the second brace, and wherein the first and second channels are separated by a working area of the elongate rail body; and first and second elongate rigid bars configured to be positioned between a closet shelf and a closet rod, each elongate rigid bar including a distal section with an upward-facing surface for engaging a bottom surface of the closet shelf, a downward-facing surface for engaging a top surface of the closet rod, and an intermediate section having a semicircular cross-section, wherein the semicircular cross-section has a flat base and an upwardly facing surface having a semicircular arc.

2. The system of claim 1, wherein the first elongate rigid bar may be moved into the first passageway with the first elongate rigid bar in a first axially rotated orientation with the flat base of the first elongate rigid bar facing the second side of the first passageway until an axis of the semicircular cross-section is in substantially the same position as an axis of the first arc of the first seat and then rotated about the axis until the first elongate rigid bar is in a second axially rotated orientation with the upwardly-facing surface of the first elongate rigid bar positioned to engage the first seat along the first arc.

3. The system of claim 2, characterized in that the first elongate rigid bar may only be removed from the first seat by first rotating the first elongate rigid bar about the axis of the first elongate rigid bar from the second axially rotated orientation to the first axially rotated orientation.

4. The system of claim 1, wherein a gap between the flat base of the first elongate rigid bar and the first brace is less than 5 millimeters with the upwardly facing surface of the first elongate rigid bar engaged with the first seat.

5. The system of claim 4, characterized in that the rail may tilt forward until the brace engages the flat base of the first elongate rigid bar.

6. The system of claim 1, wherein the first brace extends laterally in a first lateral direction from the first central axis and the second brace extends laterally in a second lateral direction from the second central axis, and wherein the first lateral direction is opposite the second lateral direction.

7. The system of claim 1, wherein the first and second sides of the first passageway are substantially parallel for receiving the intermediate section with the first elongate rigid bar in a first axially rotated orientation, and wherein the first arc of the first seat receives the semicircular cross-sectional profile of the intermediate section with the first elongate rigid bar in a second axially rotated orientation.

8. The apparatus of claim 1, wherein the first seat is semicircular.

9. The apparatus of claim 8, wherein the first and second sides of the passageway are parallel.

10. The apparatus of claim 1, wherein the semicircular cross-section of the first elongate rigid bar has a radius that is substantially equal to a radius of the first seat.

11. The system of claim 1, wherein the rail has a thickness greater than or equal to half of one inch.

12. The system of claim 1, further comprising:

a plurality of hooks secured to the elongate rigid body in the working area between the first and second channels, a plurality of pegs secured to the elongate rigid body in the working area between the first and second channels, and/or a plurality of holes formed through the elongate rigid body in the working area between the first and second channels.

13. The system of claim 1, further comprising:

a plurality of recesses form in an upwardly directed edge of the rail.

14. The system of claim 1, wherein each of the first and second elongate rigid bars have a proximal section with an upward-facing surface that extends radially outward beyond at least a portion of the semicircular surface of the intermediate section.

15. The system of claim 1, further comprising:

a second rail that is substantially the same as the first rail.

16. The system of claim 1, wherein the first and second elongate rigid bars are configured to be repositioned side-to-side between the closet shelf and the closet rod and are configured to be repositioned in a forward direction or a rearward direction between the closet shelf and the closet rod, and wherein, when in use, no portion of the first and second elongate rigid bars are fastened to the closet shelf and no portion of the first and second elongate rigid bars are fastened to the closet rod.

17. The repositionable closet bar of claim 1, further comprising:

a compressible gripping pad secured to the upward facing surface of the distal section; and a compressible gripping pad secured to the downward facing surface of the elongate rigid bar.

18. The repositionable closet bar of claim 1, wherein the first and second elongate rigid bars each have a height from 0.5 to 1.25 inches, a width from 1 to 1.5 inches, and a length from 16 to 32 inches.

19. A system, comprising:

a rail having an elongate rail body, wherein the elongate rail body includes a perimeter edge, a first channel and a second channel;

the first channel including a first seat, a first brace, and a first passageway extending into the elongate rail body from the perimeter edge of the rail body to the first seat, wherein the first seat has a first arc greater than 90 degrees, wherein the first passageway has a first side that is substantially tangent to the first arc and a second side that is offset by 1-4 millimeters from alignment with a first central axis of the first arc, and wherein the first brace has a first upwardly directed surface that extends laterally along a line that is offset by 1-4 millimeters from a first radial line of the first arc of the first seat;

the second channel including a second seat, a second brace, and a second passageway extending into the elongate rail body from the perimeter edge of the rail body to the second seat, wherein the second seat has a second arc greater than 90 degrees, wherein the second passageway has first side that is substantially tangent to the second arc and a second side that is offset by 1-4 millimeter from alignment with a second central axis of the second arc, and wherein the second brace has a second upwardly directed surface that extends laterally along a line that is offset by 1-4 millimeters from a second radial line of the second arc of the second seat;

wherein the first upwardly directed surface of the first brace is substantially colinear with the second upwardly directed surface of the second brace, and wherein the first and second channels are separated by a working area of the elongate rail body; and first and second elongate rigid bars configured to be positioned between a closet shelf and a closet rod, each elongate rigid bar including a distal section with an upward-facing surface for engaging a bottom surface of the closet shelf, a downward-facing surface for engaging a top surface of the closet rod, and an intermediate section having a semicircular cross-section, wherein the semicircular cross-section has a flat base and an upwardly facing surface having a semicircular arc.

20. The system of claim 19, wherein the first elongate rigid bar may be moved into the first passageway with the first elongate rigid bar in a first axially rotated orientation with the flat base of the first elongate rigid bar facing the second side of the first passageway until an axis of the semicircular cross-section is in substantially the same position as an axis of the first arc of the first seat and then rotated about the axis until the first elongate rigid bar is in a second axially rotated orientation with the upwardly-facing surface of the first elongate rigid bar positioned to engage the first seat along the first arc; and wherein the second elongate rigid bar may be moved into the second passageway with the second elongate rigid bar in a first axially rotated orientation with the flat base of the second elongate rigid bar facing the second side of the second passageway until an axis of the semicircular cross-section is in substantially the same position as an axis of the second arc of the second seat and then rotated about the axis until the second elongate rigid bar is in a second axially rotated orientation with the upwardly facing surface of the first elongate rigid bar positioned to engage the second seat along the second arc.

* * * * *